US007975415B2

(12) United States Patent
Jose et al.

(10) Patent No.: US 7,975,415 B2
(45) Date of Patent: Jul. 12, 2011

(54) SUPPLY CHAIN LABEL SYSTEM

(75) Inventors: Michael S. Jose, Chicago, IL (US); Mark Zavada, Evanston, IL (US); Christopher Curran, Oak Park, IL (US); Tony Christer Kilian, Safety Way, WA (US); Michael Tony Kilian, Naperville, IL (US)

(73) Assignee: Reliability Brands LLC, Oswego, IL (US)

( * ) Notice: Subject to any disclaimer, the term of this patent is extended or adjusted under 35 U.S.C. 154(b) by 948 days.

(21) Appl. No.: 11/801,821

(22) Filed: May 12, 2007

(65) Prior Publication Data

US 2008/0276513 A1 Nov. 13, 2008

(51) Int. Cl.
*G09F 3/20* (2006.01)

(52) U.S. Cl. ..... 40/654.01; 40/310; 40/649; 40/661.01

(58) Field of Classification Search ..... 40/306, 40/310, 326, 5, 653, 332, 661.01, 642.02, 40/649, 650, 660; 292/194, 195, 198, 202, 292/212, 203, 301, 347

See application file for complete search history.

(56) References Cited

U.S. PATENT DOCUMENTS

| | | | | | |
|---|---|---|---|---|---|
| 3,109,619 | A * | 11/1963 | Krug et al. | ..... | 248/690 |
| 4,236,331 | A * | 12/1980 | Mattson | ..... | 40/1.5 |
| 4,509,277 | A * | 4/1985 | Bolton | ..... | 40/1.5 |
| 4,951,596 | A * | 8/1990 | Wallace, Jr. | ..... | 116/321 |
| 5,369,899 | A * | 12/1994 | Reeves | ..... | 40/1.5 |
| 5,592,767 | A * | 1/1997 | Treske | ..... | 40/649 |
| 6,006,455 | A * | 12/1999 | Miller | ..... | 40/1.6 |
| 6,405,983 | B1 * | 6/2002 | Goj | ..... | 248/205.1 |
| 6,862,827 | B2 * | 3/2005 | Gregory | ..... | 40/661 |
| 7,308,771 | B2 * | 12/2007 | Memelink | ..... | 40/649 |
| 2003/0079389 | A1 * | 5/2003 | Eberly | ..... | 40/586 |

* cited by examiner

*Primary Examiner* — Joanne Silbermann
*Assistant Examiner* — Shin Kim
(74) *Attorney, Agent, or Firm* — Thompson Coburn LLP

(57) ABSTRACT

A best practice fluid identification system for managing fluids from bulk storage to point of use on products and equipment in residential, commercial and industrial applications where the fluid and product or equipment information travels with the fluid and its dispensing in a protective holder mounted on or near the point of use and also on the dispensing device.

11 Claims, 23 Drawing Sheets

SUPPLY CHAIN LABEL SYSTEM

TECHNICAL FIELD

The invention relates to a fluid identification system for identifying fluids, and more particularly, to an advanced supply chain label and fluid management system for identifying bulk storage of fluids by providing information labels attached to the container in bulk storage and to the fluid dispensing products and equipment at the point of use in residential, commercial and industrial applications.

BACKGROUND OF THE INVENTION

Various containers and vessels that carry fluids and lubricants are found in every household, commercial building and industrial factory. For safety reasons as well as the proper application and use of the fluids and lubricants, it is important that the person dispensing the fluids or lubricants is able to identify the exact fluid or lubricant being used for a particular application. Often times due to the environmental and other conditions, the label properly identifying the fluid or lubricant for an application to products or equipment is missing information about the fluid in bulk storage or at the point of use on the dispensing product or the equipment receiving the fluid.

Missing labels in bulk storage or on the dispensing products may result in unsafe usage of the fluids or lubricants resulting in damage to property, machinery or even to the end user. Also, for safety reasons if the fluid or lubricant is spilled during dispensing, it is important to know how to deal with the spillage. Safety information needs to be readily available on the dispensing container or vessel itself where the end user can readily avail themselves of the instructions and act before further damage occurs to person or property.

In the industrial setting, a best practice fluid identification system is all but a necessity to increase profitability in the factory. Countless times, factory maintenance personnel are found to misidentify fluid containers or vessels and then misapply lubricants to machinery resulting in costly equipment failure or unnecessary downtime to fix the problem of the misapplication of the fluids including the costly repairs to the failed equipment. There is a great need to fix this often dangerous and damaging problem. Labels that come on bulk containers or vessels are often damaged in shipment, storage or repeated handling of bulk container by forklifts and the like and as such the labels are not legible because they are all but erased or damaged to the point that identification becomes impossible. Also, the fluids or lubricants in most factory settings are stored in bulk quantities to reduce their costs so that maintenance people in the factory are continuously transferring the fluids and lubricants into smaller containers for dispensing at the point of use on factory machines. Unless there is some type of advanced fluid or lubricant management system in place from bulk storage to point of use, one can expect that human error will come into place and mistakes will be made in the application of fluids or lubricants in the ordinary course of maintenance work. In the transfer of fluids and lubricants from bulk containers to smaller container or vessels, maintenance personnel will use whatever is available or at hand. This often includes coffee cans, various metal or plastic containers, drums, bottles or other vessels with ill fitting pouring spouts and just about anything else handy that will hold the fluids or lubricants for dispensing. Although the first party who transfers the fluid or lubricant from a new bulk storage container in storage to a hand container or vessel may apply the correct fluid or lubricant, once the container in bulk storage is used a number of times erasing the markings or labels thereon or the smaller dispensing container and vessel are returned to maintenance or left on the factory floor, proper identifying labels with information about the fluids is necessary to avoid mistakes from happening. This is the area that most proper applications of fluids breaks down even in a residential setting.

Moreover, it is important that proper instructions and warnings follow the fluids and lubricants from bulk storage to the point of use during their application. Suppose a maintenance worker spills a volatile fluid on the factory floor while filing up a machine reservoir and the fluid needs to be cleaned up immediately to prevent a danger to others. Beside the obvious slip and fall accident, a particular fluid may cause personal injury if the fluid comes into contact with skin of the end user or a co-worker. If instructions are available at point of use for the fluid by having a readily available warning and instruction on how to properly clean up the spillage, such an injury may be avoided entirely. Or a co-worker on the next shift sees a fluid container or vessel next to a particular machine tool will usually assume that it is the correct fluid for that equipment. So maintenance personnel at the beginning of the shift see the fluid container or vessel left next to the machine on the factory floor. A natural assumption is made about that the fluid or lubricant in this container or vessel next to the machine especially if the container looks similar to one previously used and the worker dispenses the fluid into the equipment. However, this is seldom the case and the improper fluid or grease is usually used with the resulting damage to the machinery, equipment or surrounding property. Without a best practice fluid identification system in place, errors will occur more often than not resulting in costly downtime. An advanced fluid management system is especially required when going from bulk storage to point of use in the factory setting.

Therefore, there is a definite need for a fluid identification system tracing the fluids from bulk storage to dispensing at the point of use. There is also a requirement that the fluids or lubricants are identifiable at all times from bulk storage to point of use whether the bulk fluids or lubricants are offsite or onsite. In short, a fluid inventory management/process control begins with the ability to track and properly use the fluids or lubricants in residential, commercial and industrial settings. Also, application and warning information needs to accompany the fluids or lubricants throughout the movement from bulk storage to the point of use in the residential, commercial or industrial settings. Labels with information need to be present on the containers and equipment wherever the fluids travel in their supply chain.

A problem also exists with the common adhesive type labels found on dispensing drums, bottles, aerosol cans, bulk drums, containers and vessels. It is the ability to stay clean and viable so the maintenance people or homemaker can read the labels and get the necessary instructions. Over a period of time, most labels become unreadable at best and may even be misleading when parts are missing due to degradations of the labels from spillage of fluid or lubricant across the face of the label erasing the pertinent information over time. A proper label holder system also needs to have the ability to change out the labels and instructions if important changes are made to the information concerning the storage and handling of the fluids or lubricants. Current label holder systems often lack the ability to make quick changes to this information. It also is not uncommon to need to send out additional information about a fluid or grease when federal or local authorities make changes to the law with regards to the fluids and lubricants.

In addition, it is important not only to rapidly change out the labels in the holder but also to prevent the labels from receiving damages due to moisture or to the fluids and lubricants being spilled directly onto the labels when dispensing from the containers or vessels. Some applications require more detailed instructions on how to apply the fluids and oils; in that case, it may require the ability to handle multiple sets of instructions or warnings in separately organized vouchers that accompany the product to market.

The type of items beside the drum fluid or grease containers that often require one or more labels for application, warnings, safety instructions and the like includes, fire extinguishers, grease guns, gas bottles, Scuba tanks, pipes, cables, household or commercial aerosol cans, bottled water, soft drink cans, filler plugs on machine tool reservoirs beside lubrication joints, trucks and other vehicles and fence posts to just name a few. Therefore, it is an essential aspect of any fluid identification system to have a label holder system capable of handling multiple individual labels with different information associated therewith. Many factory installations of equipment require point of use OSHA or Factory Mutual safety regulations so the label holder system must be able to accommodate these separate regulations in a pocket or file that is easily identifiable on the label holder system to verify compliance with the regulations. Also, factory equipment with regular maintenance schedules need information of inspection and testing requirements to reside in close proximity to the equipment so that the label holder system must be able to accommodate these informational requirements too.

The present invention is provided to solve the problems discussed above and other problems, and to provide advantages and aspects not provided by prior label holder systems of this type. A full discussion of the features and advantages of the present invention is deferred to the following detailed description, which proceeds with reference to the accompanying drawings.

SUMMARY OF THE INVENTION

According to the present invention, a label holder system is provided. Very generally, the label holder system includes a tubular post having a predetermined length extending generally upwardly and perpendicular to a base at one end and at the distal end including a pair of opposing generally flat, rectangular blades attached to the distal end of the post and being generally parallel to the base and a generally flat nib of a predetermined thickness connected at one end to the top of the post and having a slot extending inwardly from its distal end a predetermined distance. A generally flat, rectangular shaped, flexible and clear plastic pocket with a generally clear and integral top flap forming a pocket to insert information protected from the elements when the flap is in its normal closed position and having an opening through the top end of the pocket slightly above the pocket and flap having a slightly smaller dimension than the shape of distal end of the post with its opposing blades but cooperating therewith to pass the opening over the blades and distal end of the post with a minimum of manipulation of the opening to secure the pocket behind the opposing blades on the post.

A frame slightly larger and corresponding to the shape of the pocket. The frame having a predetermined thickness and an opening at the top thereof forming a slot extending downwardly on the inside length of the frame a predetermined distance to slidably receive the pocket into the top opening in order to slide the pocket all the way down to the bottom of the frame securing the pocket in place within the frame. A female receptacle mounted near the top of the frame on one side of the frame for receiving the slotted nib in a snap fit wherein the slotted halves of the nib flex toward one another to form the snap fit therein to support the frame in a fixedly secured position on the post slotted nib. When the distal end of the nib is fully inserted into the female receptacle, the distal end of the nib only extends the length of the interior of the female receptacle. Thus the pocket is inserted and removed from the frame slot without interference from the slotted nib when the frame is mounted on the nib.

As to specifics, the frame is comprised generally of an opaque plastic, but the frame is also capable of being constructed of a clear plastic. The frame is more rigid in construction due to its thickness and its inner slot extends a predetermined distance into the frame around its interior surface on each of its two parallel sides and its bottom side.

A generally flat split ring frame designed to fit around the neck of a drum, bottle or container containing a fluid, the split end of the ring frame includes a finger with a generally round tapered end and an opposing tapered slot corresponding to the finger and its round tapered end to lock the finger into the tapered slot for holding the ring frame in place around the neck of container. Opposite the split end of the ring is an outwardly and downwardly extending finger of a predetermined length having the same post with the blades and nib as previously described above for attaching one or more plastic pockets and a frame thereto. The flat split ring further including at least two spaced apart cutouts on the inner ring surface opposite the downwardly extending finger and spaced apart a predetermined distance from the finger attached to the outer surface of the split ring. Each cutout having a flexible thumb extending generally across the length of the cutout attached at one end of the cutout and extending outwardly from the inner surface of the spit ring a predetermined distance to engage the neck surface of a drum, bottle or container. Each finger flexes inwardly into the cutout as it engages the neck surface of the container to prevent the split ring collar from rotating on the neck of the bottle or container when tipping the container to pour fluid out of the container.

According to another aspect of the invention, an elongated tie of a predetermined length includes a generally round split male nib projecting perpendicular above the tie length at one end and at the other end includes a female opening throughout wherein upon bending the elongated tie in half the split male nib snap fits into the female opening to form a secure loop for fastening around a container handle, a pipe or other fluid or lubricant device. The male or female members on the tie fit through the opening in the pocket so information can be placed into the pocket and then the tie secured on the container or equipment that requires a fluid or lubricant during maintenance to identify the proper fluid or lubricant to be used.

According to still another aspect of the present invention, a partial semicircle wrap around label holder having a predetermined height and radius to match any cylindrical surface snap fits onto any cylindrical surface and is able to slide up and down on the cylindrical surface to a location where it does not obstruct the user use of the cylindrical device. The cylindrical holder when the actuator is in the second position, at least a portion of the actuator depresses (or depressed) the switch.

According to a further aspect of the present invention, the pocket with the information concerning fluid management needs to be applied at the point of use with a machine tool or other device having a reservoir requiring fluids or lubricants. The reservoir usually has a filler plug on top of the reservoir tank for the machine tool or other factory device. A generally flat plastic collar having an opening in the center defining the inner edge of the collar and an outer edge extending a predetermined distance from the inner edge and having the opening constructed in varying sizes to fit around the neck of different sized cylindrical plugs located typically on top of a reservoir tank to be filled with a fluid or lubricant. The collar includes a generally flat projection extending horizontally outwardly from the outer edge a predetermined distance and terminating in a male end. A hinged clamp includes a horizontal female member for receiving the male end in a snap fit engagement at the distal end and connected at its other end to one leg of an A-frame shaped clamp. One leg of the A-framed clamp extends at an acute angle upwardly from the joined male and female members to form one side of the A-frame shape and it terminates in a horizontal T and generally rectangular cross member having a length corresponding to the width of the pocket. The second leg of the A-frame extends upwardly and terminates in a horizontal T rectangular cross member having a length greater than the first leg cross member. Each leg includes a pair of projections located on the side of each leg facing the other leg of the A-Frame and spaced apart on each leg and each projection having a hole to receive a pivot pin therethrough when the holes on the projections of the first leg are aligned with the holes on the projections of the second leg to form a hinged connection between the two legs and form the horizontal bar in the letter "A". The outer surface of the spaced apart projections on the second leg are closely adjacently the inside surface of the spaced apart projection on the first leg when the holes are aligned and the pivot pin is inserted. In this alignment the pivot pin includes a spring around the pivot pin with the opposing ends of the spring extending downwardly from the pivot pin to engage the inner sides of each leg having the spaced apart projections to form a clamping action between the two T-cross members of each leg. In operation, the end user pushes on the bottom second leg outer surface and against the spring pressure keeping the cross members clamped together with the first cross member inside the slot area of the second cross member and opens the distance between the two cross members so a pocket with information may be inserted into the slot of the second cross member. The end user removes the finger pressure against the bottom second leg member and the first and second cross members clamp shut on the bottom portion of the pocket placed in the slot of the second cross member to hold the pocket in an upright position with the identification information visible within the clear plastic pocket. In addition, the second cross member on the second leg includes a male nib generally located in the center of the cross member and inline with the second leg to receive a frame in which additional pockets may be inserted with further application, fluid identification or safety information for the particular machine tool or the like for the factory setting. Both the clamp and the male nib with a frame attached thereto provide easy access to fluid management information in the factory setting and makes it very easy for the maintenance people to properly identify the safety instructions for changing fluids at a particular machine and sufficient safety messages in case of spillage or other problems or warnings associated with the particular machine. Moreover, if there are changes to be made in the fluid management information or a new safety aspect to inform the maintenance or machine operator, the new information can easily placed within the pocket by unclamping it and inserting the new information. The same thing applies to the frame in which the pocket can be slid out of the frame and the fluid management or safety information can be easily inserted into the pocket and then replaced. In fact, safety information may go into the pocket within the frame in front of the clamp and the pocket on the clamp could be the maintenance schedule information about the daily, weekly or monthly maintenance information regarding fluid maintenance of the machine or other device.

According to still another aspect of the present invention, the pocket may be magnetically mounted to metallic members on a machine or other device. The tubular post and male nib is capable of being mounted to a magnet in which a generally circular magnetic dome housing having an opening at its base that incorporates any known magnetic material extending beyond the bottom opening of the dome to attach to the metallic surface of the machine. On the top surface of the dome and generally located in the center of the top surface the post extends perpendicular to the top surface of the dome with its blades and male nib, which are inserted into the female slot on the frame. The frame may include female slots on its top and bottom members with the fluid management and safety information inserted into the pocket that is then slid into the frame as previously described above.

According to yet still another aspect of the present invention, the various components described above could all be used on a particular machine. For example, a machine in a factory setting may use each and every one of the components in the Supply Chain Label System. The machine may have a pipe feeding some fluid or other element into the machine. This pipe includes a wrap around cylindrical label holder to provide the information concerning what fluid or other thing it is being used in conjunction with this machine. The machine may include a reservoir tank of an operating fluid so it might have the collar around its filler plug and the clamp attached thereto providing maintenance, safety or warning information to the operator of the machine. A particular working area around the machine may have a tie holder around a handle or operating button with a tag in the pocket providing information concerning the operation of the machine or an indication that they machine is down for maintenance and should not be operated until the maintenance is finished. Many of the machines and equipment such as forklifts are made of a metallic material so the post with the male nib are mounted on a magnet and the nibs are connected to a frame attached to the side of the machine or to metal cage or rail of the forklift with a pocket inside providing the relevant fluid management information or safety instructions prior to operating either machines. So there are endless usages of the supply chain label system of the present invention as the components thereof are adaptable to most situations.

According to yet another aspect of the present invention, the sensor includes a second sensor package disposed within the sensor housing. The second sensor package is comprised of third and fourth screens. A sensing membrane is disposed between the third and fourth screens and is adapted to expand when exposed to a predetermined quantity of a first predetermined fluid. An intermediate sensor membrane is disposed between the fourth screen of the second sensor package and the first screen of the first sensor package.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which:

FIG. 34 is a perspective and partial exploded view of the assembly as shown in FIG. 33 with the frame including a pocket with identification information therein attached in a manner to hang down from the clamp and over an edge of a reservoir tank or the like.

DETAILED DESCRIPTION

Figure 1:
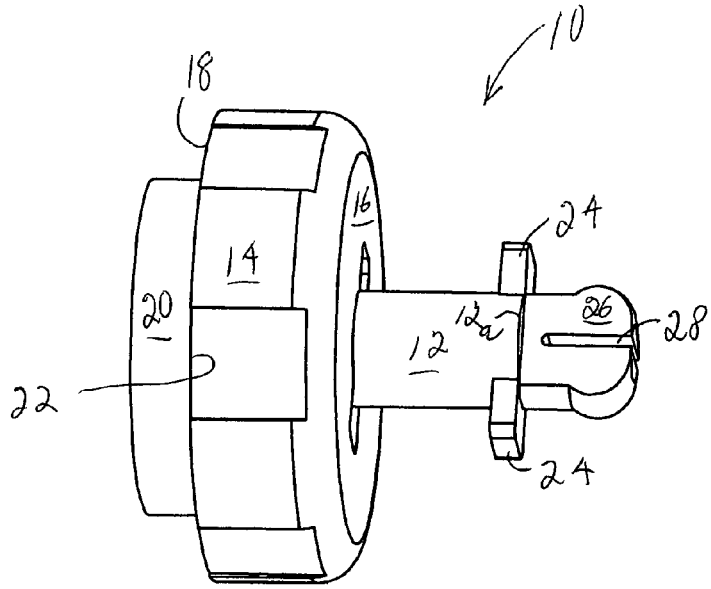
FIG. 1 is a perspective side view of a pocket holder post mounted on a magnetic dome including a pair of blades and male nib component made according to the teachings of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention is a supply chain labeling system comprising a number of plug on components making up the fluid management and identification system for a fluids or lubricants typically applied to machines in a factory setting as shown in the FIGS. 1-34. Turning now to FIG. 1, at the heart of the system is a holder 10 including a generally tubular post 12 attachable to a number of different configurable bases. On base 14 in the shape of a cap with a generally flat top surface 16 and an open bottom 18. A magnet 20 is fixedly inserted into the cap through the bottom opening 18 and its distal end 22 is generally flat for mounting on metallic surfaces of a machine or the like. The post 12 is connected to the top surface 16 of the cap 14 and terminates at its distal end 12*a* in a pair of opposing rectangular and flat blades 24, which generally extend perpendicular from the axis of the post 12 at the distal end 12*a* a predetermined distance and the blades are generally parallel to the top surface 16 of the base 14. Extending upwardly at one end in an axially direction from the distal end 12*a* of the post 12 is a generally flat male nib having a bulbous distal end 26 with a slot 28 projecting along its axis and extending through the width of the nib and extending toward the one end a predetermined distance. The slot 28 splits bulbous end in half so when the bulbous end 28 is inserted into a female slot, the split bulbous end 26 flexes its halves inwardly toward the slot and causes a snap fit of the bulbous end 26. The post 12 is capable of attaching to a number of different bases as previously stated and there is no particular limitation to the base except that the base is generally parallel to the blades at the top of the post 12.

Figure 2:
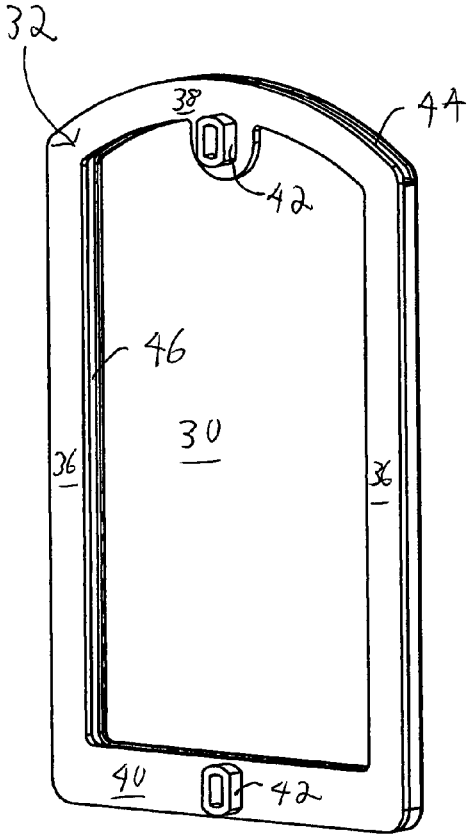
FIG. 2 is a rear plan view of a frame designed to be attached to the male nib as shown in FIG. 1.
Figure 3:
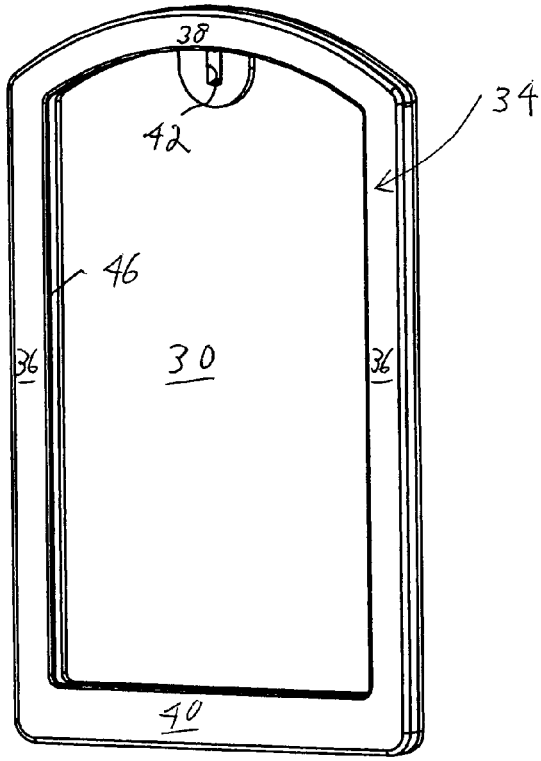
FIG. 3 is a front plan view the frame shown in FIG. 2.

Referring now to FIGS. 2 and 3, a frame 30 is shown. The frame 30 resembles a door with an arch at the top. The frame 30 is generally flat on both the front and rear sides 32 and 34, respectively. The frame includes a pair of parallel and vertical rails 36, an arch top rail 38 and a horizontal straight bottom rail 40. A pair of female receptacles 42 is mounted on the rear side of the frame 30 with one centered in the middle of the arch at the top of the frame 30 and the other one centered in the middle of the bottom rail 40. The frame 30 includes a slotted opening 44 disposed midway in the width of the frame 30 that extends downwardly through the middle of the rail width to the bottom 40 to form grooved slots 46 that extend the length of the rails 36.

Figure 4:
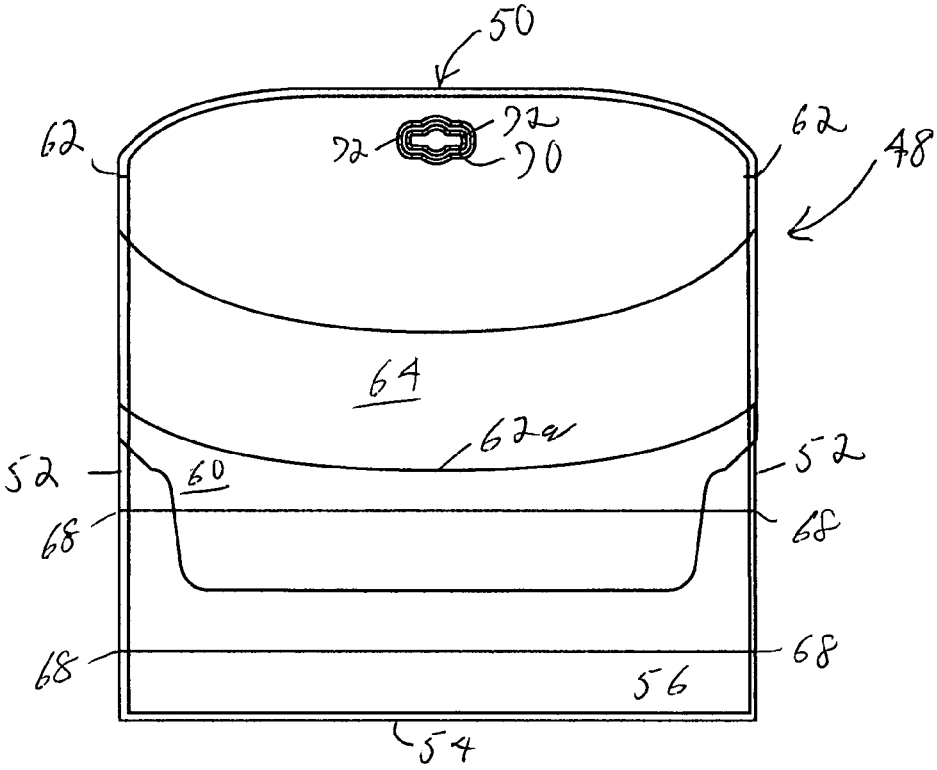
FIG. 4 is a front plan view of a first pocket designed to fit over the male nib and pair of blades and rest on the post as shown in FIG. 1.
Figure 5:
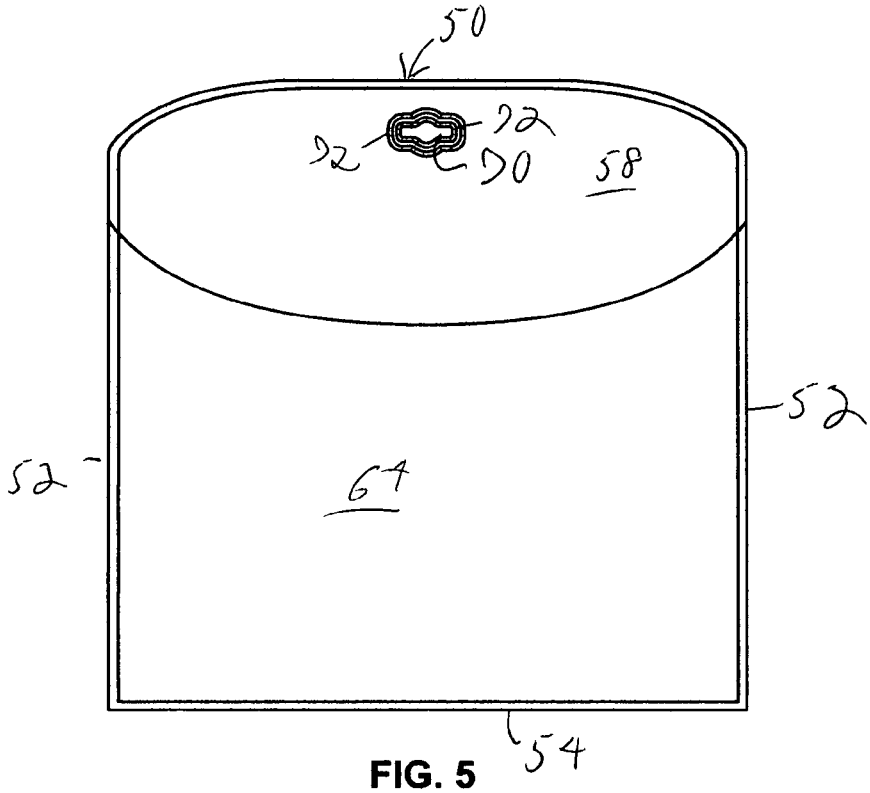
FIG. 5 is a rear view the first pocket shown in FIG. 4.

FIGS. 4 and 5 show a front and rear of another component of the supply chain label system, respectively. FIG. 4 shows a front view of a clear and flat plastic label pocket or pouch 48 having a pocket formed by a top arch 50 a pair of vertical sides 52, a bottom 54, a front panel 56 and a back panel 58 as shown in FIG. 5. A front tongue 60 connected to the front panel 56 creates an opening when lifted to approximately the lines 62 near the top of vertical sides 52. The front and rear panels 56 and 58 are sealed together on their edges including the top 50, vertical sides 52, and bottom 54 sealing the front and rear panels together to form an essentially moisture free pouch. This combination of front and rear panel 56 and 58 sealed at the top, sides and bottom form the pocket for inserting information while protecting the information for soil and moisture. Access to the pocket in the pouch is achieved by lifting the front tongue 60, which overlays the opening to the pocket on the front side 56 and overlays a backing material 64 located between the front panel 56 and the rear panel 58. The backing material 64 is generally opaque and identification information or instructions can be inserted into the pocket on either side of the backing material 64, which acts as a backboard to display different information so that the inserted information is either loaded in front of the backing material 64 or behind the backing material facing outwardly from the backing material 64 to read the information. Therefore the end user does not see through the entire clear plastic pocket to have script confusingly overlapping from material facing outwardly but bleeding through the paper so that the script is seen printed backwards from printed material facing the opposite way in the pocket. Thus the opaque backing material generally makes sure that you only see the printed material designated to be seen from that side of the pocket. In addition, as shown in FIG. 4 the tongue 60 is inserted behind a flap 66 designated by lines 68 on the front panel 56 and tied to the vertical sides 52. The width of the pockets 48 in FIGS. 4 and 5 are two wide to fit into the frame 30.

Next both FIGS. 4 and 5 show another important feature of the generally rectangular shaped pocket and that is an opening 70 extending through the front and rear panels 56 and 58 near the top arch 50. The pocket opening 70 is used to mount the pocket on the post 12 of FIG. 1. Pocket opening 70 is generally in the shape of the cross section of the post 12, blades 24 and bulbous end 26 together with the exception of the opposing corners 72 of the pocket opening 70 that are rounded instead of rectangular to provide an interference fit between the pocket opening 70 and the blades 24 when aligning the pocket hole 70 with the blades 24 to insert the pocket hole 70 over the blades to capture the pocket 48 on the post 12 behind the blades 24. This interference fit makes it virtually impossible for the pocket 48 to fall off of the post 12 during any pouring operation that may cause the captured pocket 48 to rotate about the post 12 due to the loose fit of the pocket opening 70 around the post 12. Since the pocket opening 70 is slightly smaller at its rounded corners 72 than the footprint of the rectangular blade 24, the pocket 48 is securely attached to the post 12 as the pocket 48 is rotated around the post 12. This rotational movement of the pocket about the post occurs each time a container is tipped from an upright position to its side position when pouring fluid from the container.

Figure 6:
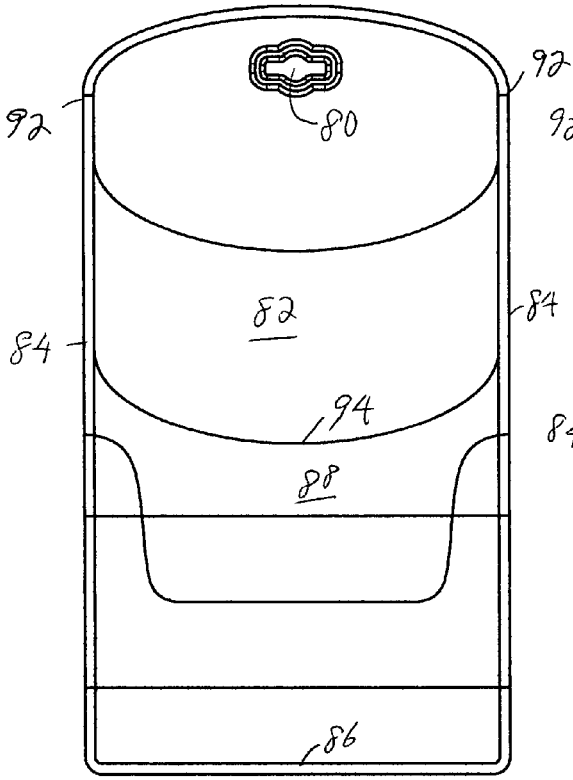
FIG. 6 is a front plan view of a second pocket insertable into the frame of FIGS. 2 and 3 for mounting purposes.
Figure 7:
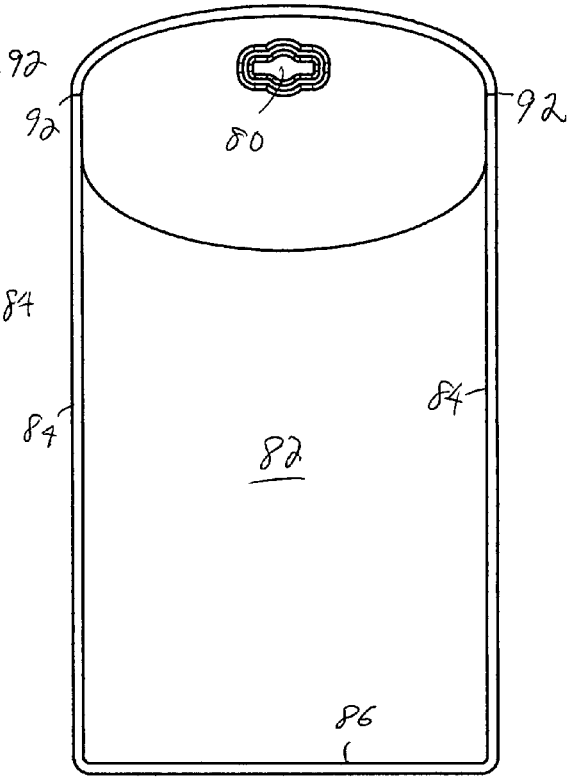
FIG. 7 is a rear plan view of the second pocket as shown in FIG. 6.

Referring to FIGS. 6 and 7, a narrower front and rear view of a clear plastic label pocket 78 is shown. The construction of this pocket is exactly the same as the label pocket 48 with the pocket opening 80 used to hang the label pocket 78 on the post 12. An opaque material 82 with an arcuate upper portion is inserted into the pocket of the pocket 78 and captured by the sealed vertical sides 84 and sealed bottom 86 of the pocket 78. A tongue 88 is captured by the clear flap 90 in its normally closed position just like the tongue 60 on the pocket 48. The tongue 88 opens to the lines 92 on the vertical side edges 84. A opening when the tongue 88 is pulled all the way open extends from the lines 92 and a curved line 94 just like on the pocket 48 where the opening to that pocket is defined by the lines 62 and the curved line 62*a*. However, the narrowness of the pocket 78 allows it to be inserted into the slotted opening 44 in the frame 30, which will be described in greater detail later in FIG. 8.

Figure 8:
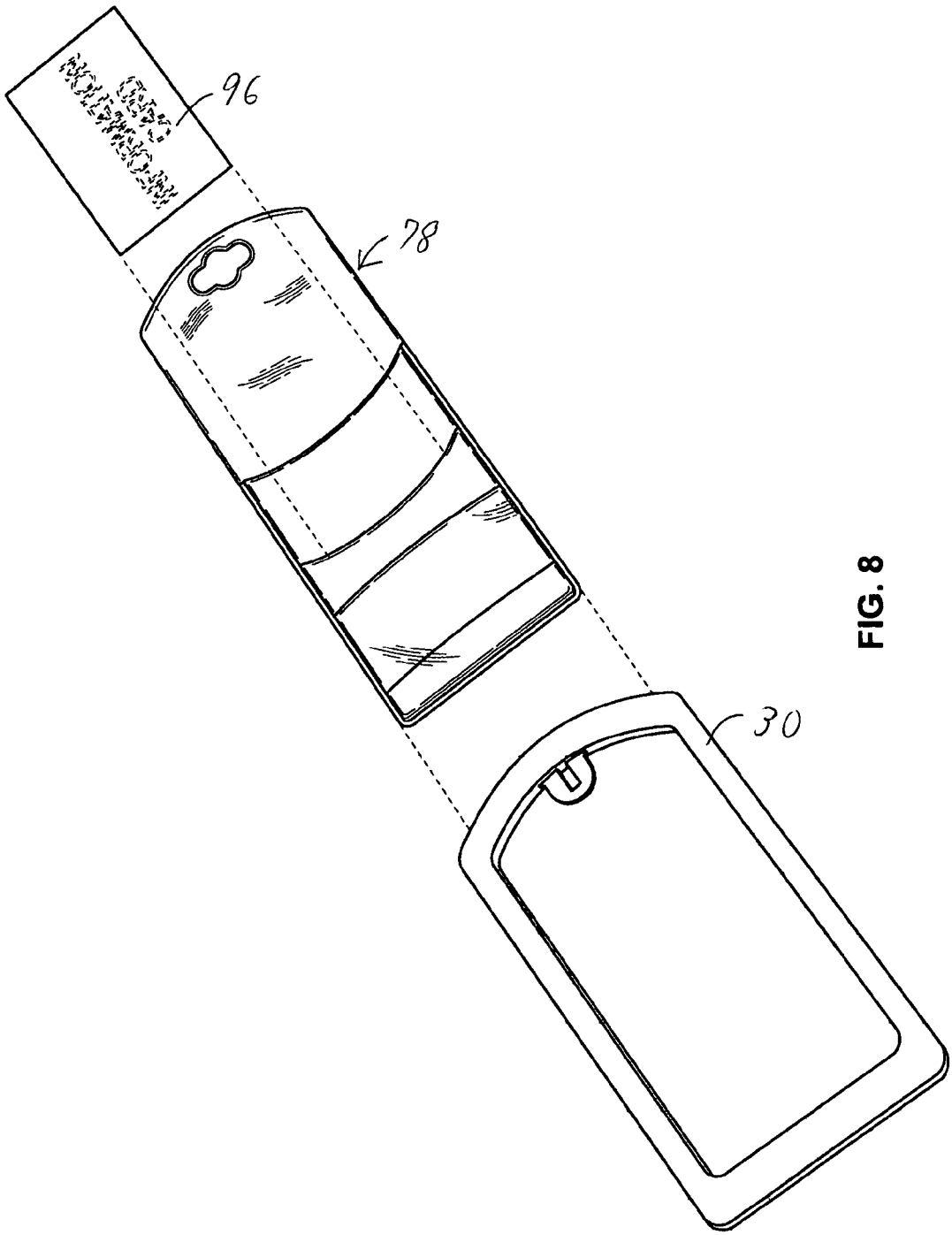
FIG. 8 is a perspective view of the frame as shown in FIGS. 3 and 4 having the pocket of FIGS. 6 and 7 with an information card both being inserted into the frame.

FIG. 8 shows an exploded view of the pocket 78 as shown in FIGS. 6 and 7 being positioned to be inserted into the slotted frame 30 with an information card 96. The information card 96 contains information about the fluid in the container or fluid in a machine reservoir tank or safety instructions or even information about the operation of the machine. Generally, the end user or maintenance personnel at the factory place the information card 96 into the pocket of the pocket 78. The pocket 78 then has its bottom 86 inserted first into the slotted opening 44 at the top of the frame 30 in which the vertical edges 84 of the pocket 78 frictionally engage the vertical slots 46 on the vertical parallel sides or style rails of the frame 30.

Figure 9:
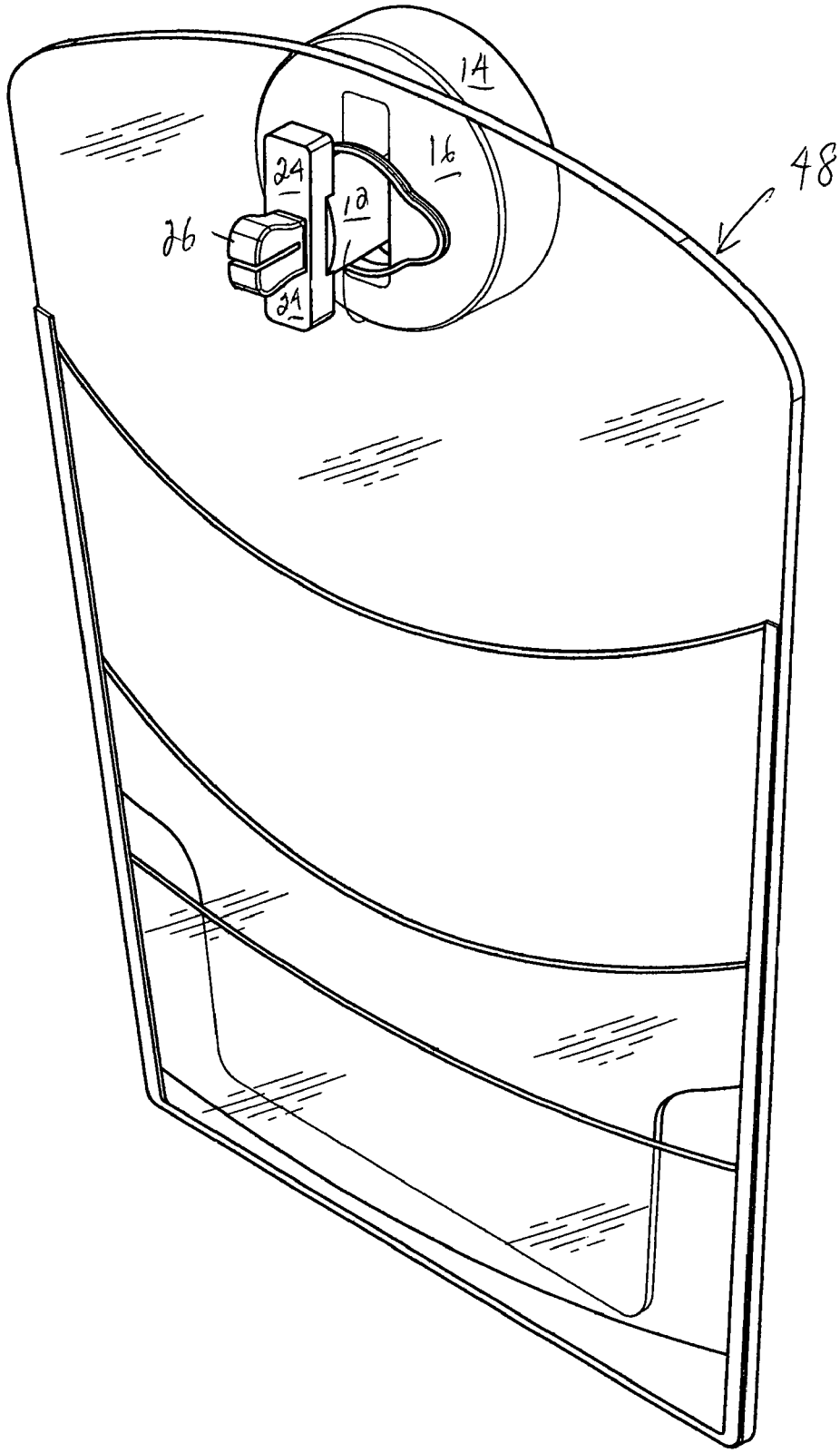
FIG. 9 is a perspective view of FIG. 1 with the first pocket of FIGS. 4 and 5 inserted over the blades and male nib and resting on the post as shown in FIG. 1.

FIG. 9 shows the pocket 48 mounted on the post 12 attached to the magnet housing 14 such that the label pocket 48 is hanging vertically downward from the post 12 when the magnet is attached to a machine tool or the like.

Figure 10:
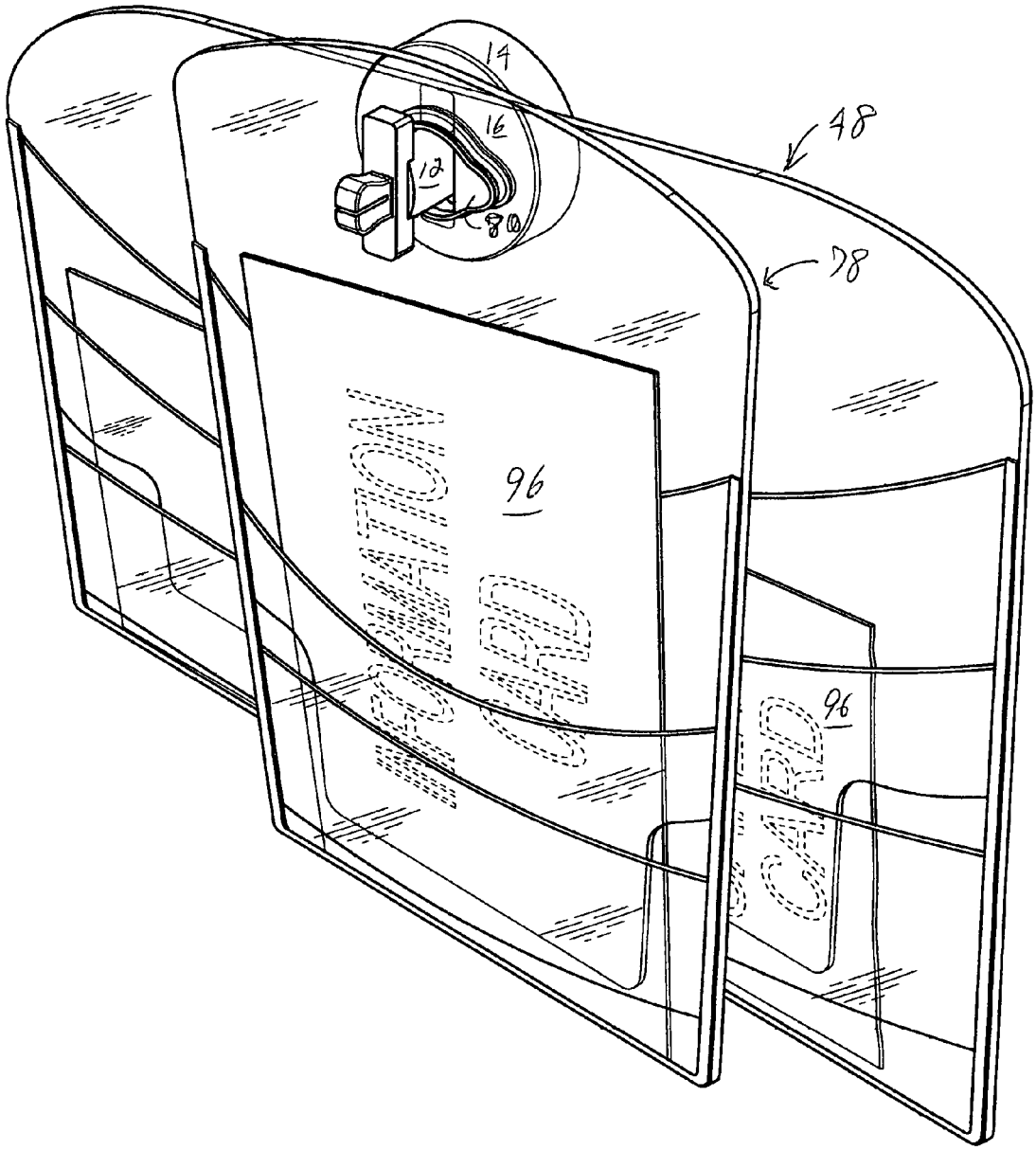
FIG. 10 is a perspective view of the first and second pockets mounted on the post of FIG. 1.

FIG. 10 shows both type of label pockets 48 and 78 attached on the post 12 with both pockets hanging vertically downward from the post 12 with information cards 96 inserted into both label pockets 48 and 78. The openings 70 and 80 are approximately 90 degrees lengthwise from the opposing blades 24 combined length. So the blades 24 extend above and below the openings 70 and 80 preventing the pockets 48 and 78 from slipping off the post 12.

Figure 11:
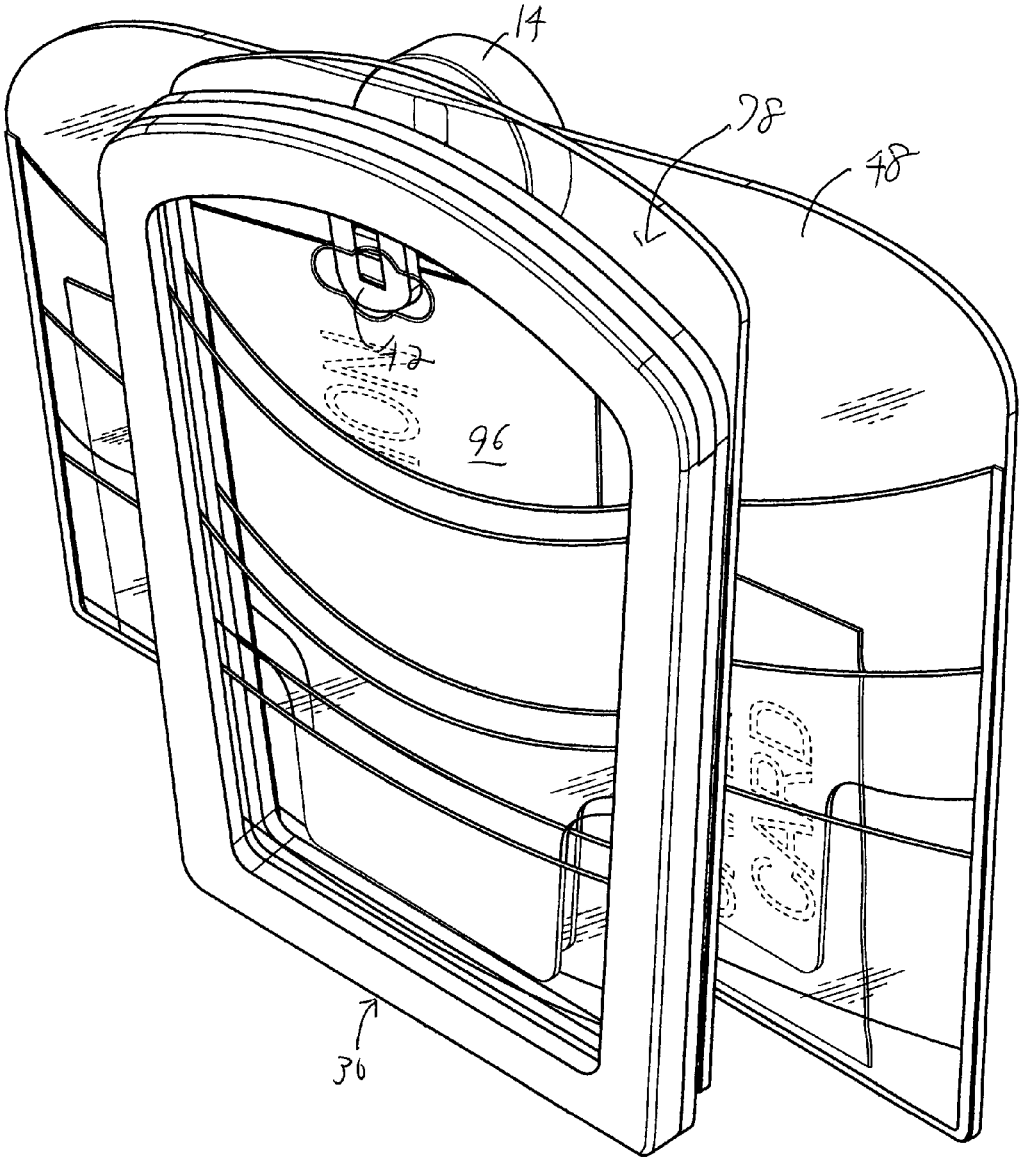
FIG. 11 is a perspective view of the first and second pockets mounted on the post of FIG. 1 and the frame of FIGS. 2 and 3 mounted on the male nib of FIG. 1.

FIG. 11 shows the pockets 48 and 78 attached or hanging from the post 12 on a magnet housing 14 with a frame 30 mounted on the male nib 26 inserted into the top female receptacle 42. The frame 30 includes an information card 96 within the pocket of a label pocket 78 in the slotted opening within the frame 30. The male nib 26 does not extend into the slotted recess in the frame 30 so the pocket 78 with the information can be slid out of the slotted opening 44 at the top of the frame 30 to change the informational card 96 within the pocket of the label holder 78. With the generally flat bulbous male nib 26 inserted into the female receptacle 42 on the frame 30, the connection between the male and female members 26 and 42 is similar to a keyed connection so the pocket 78 is rigidly held in place without movement when the container or other vessel is tipped to pour fluid out of it while the label pockets 48 and 78 are rotated about the post 12 with the tip pouring position of the container.

Figure 12:
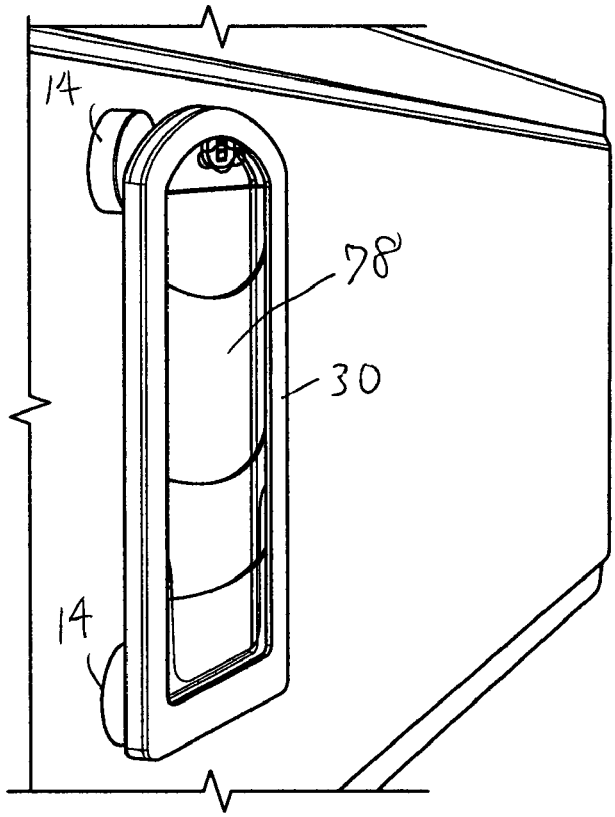
FIG. 12 is a perspective view of a pair of magnetic holder posts of FIG. 1 attached to the frame of FIGS. 2 and 3 mounted to a metallic surface.

FIG. 12 shows the frame 30 mounted to a pair of magnetic mounted projections 10, with one nib 26 connected to the female receptacle 42 at the top of the frame and the other nib 26 connected to the female receptacle 42 (not shown) on the bottom horizontal rail of the frame 30. A plastic pocket 78 is inserted into the frame 30 allowing for the inclusion of a data information card therein and the magnetic mounts 14.

Figure 13:
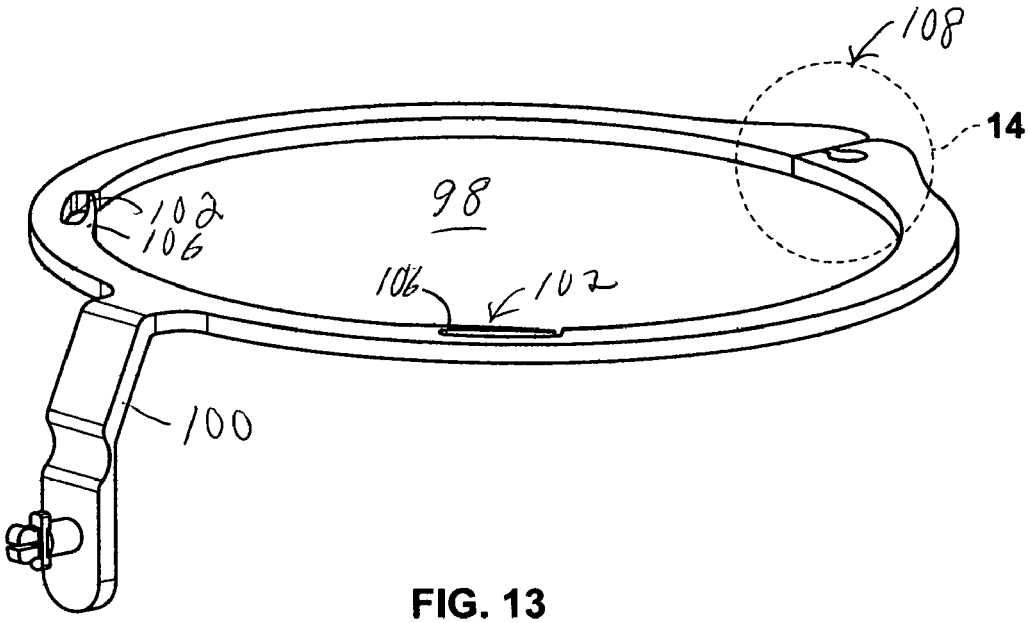
FIG. 13 is a split label holder ring including the post, blades and male nib of FIG. 1.

FIG. 13 shows a different holder that is a generally flat collar or ring 98 of a predetermined diameter and thickness with a finger 100 extending downwardly with the post 12, blades 24 and male nib 26 for attaching the pockets 48 and 78 to the post 12 and the frame 30 connected to the male nib 26 for holding yet another pocket 78. The diameter of the ring 98 depends on the size of the neck of a container or vessel. The ring 98 includes to a pair of cutouts 102 on its inner circumference 104 of the ring spaced apart on either side of the hanger 100 and each cutout having a tab finger 106 connected at one end of the cutout 102 and extending across the cutout a predetermined distance with a slight bend inward to the axis of the ring to frictionally engage the neck of a fluid container to prevent rotation of the ring during manipulation of the fluid container. The tab fingers 106 flexing outwardly from the neck of the container and into the space of the cutouts 102 when attached to the neck of the fluid container. The ring 98 further includes a separable joint 108 that is shown in greater detail in FIGS. 14A and B. The ring joint 108 is generally located opposite of the finger 100 on the ring 98. The ring joint 98 is easily manipulated by the fingers of a user to separate the joint and permitting the ring diameter to be increased by pulling the respective sides of the joint apart to fit around the neck of the container and then the joint 108 is reassembled again to secure the collar or ring 98 on the neck of the container.

Figure 14A:
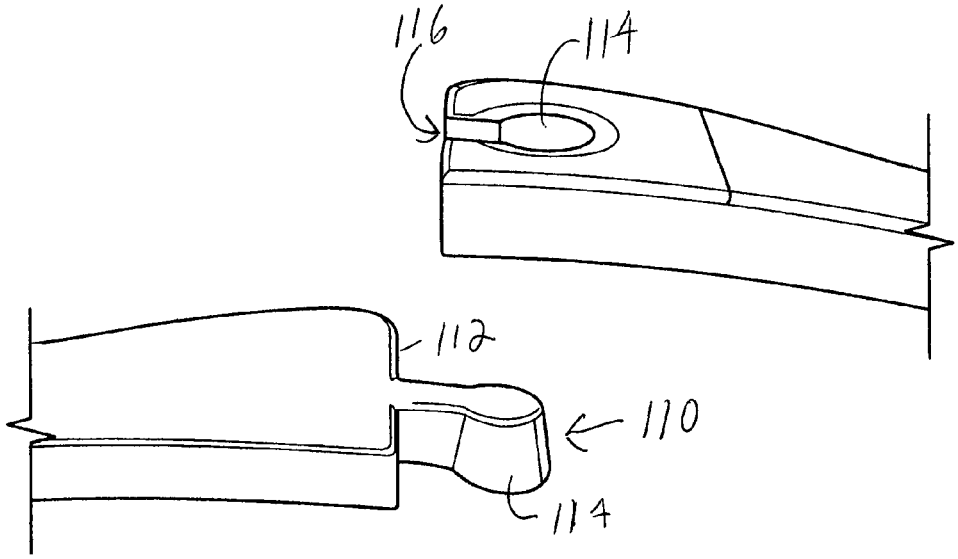
FIG. 14A is a partial perspective view of the ring of FIG. 13 showing the connecting members of the ring disassembled and split apart.
Figure 14B:
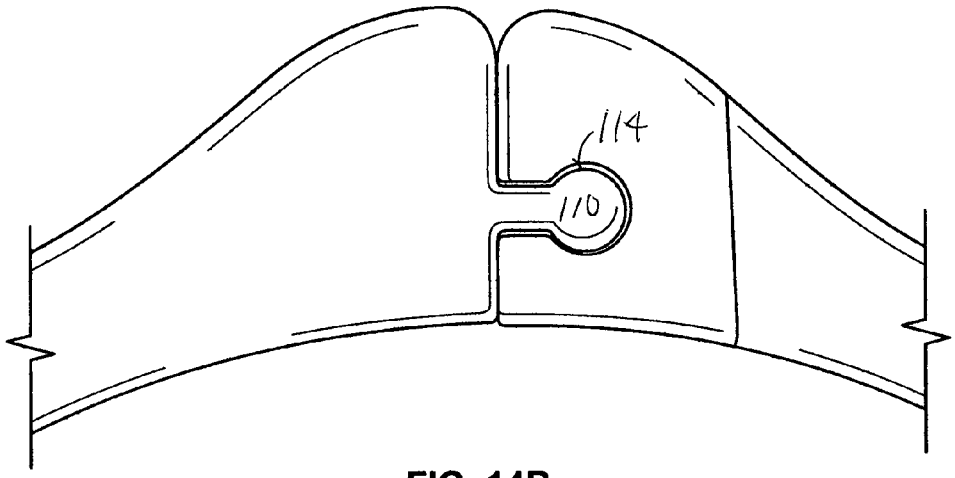
FIG. 14B is a partial top plan view of the ring of FIG. 13 showing the connecting members assembled.

FIGS. 14A and 14B show the ring joint 108 and its structure and the relationship of it component halves to one another as the halves are separated and then rejoined together again. One half of the joint 108 includes a male joint finger 110 extending outwardly from an adjoining surface 112 at the end of the one half ring joint 98A having approximately the same thickness as the ring 98. The finger 110 terminates in a tapered bulbous member 114. The other half of the joint 108 includes a female joint 116 extending through the thickness of the other half of the ring 98B and inwardly from an adjoining surface 118 on the other half and terminating in tapered recess 120 corresponding to the tapered bulbous member 114 to receive the entire finger 110 and bulbous member 114 to join both halves together in a locked fashion when attached to the neck of a container. In assembling the ring around the neck of a container, the joint finger 110 and bulbous member 114 are aligned either below or above the female joint 116 depending on the direction of the taper. In FIGS. 14A and 14B the taper shown means the first half 98A with the male joint finger 110 is aligned below the female joint 116 on the second half 98B and the first male half of the joint 108 is moved upwardly into the second female half of the joint 108 to assembly the joint of the ring 98 so that the adjoining surfaces 112 and 118 closely abut one another in the final assembled joint 108 with surfaces 120 between the two halves tightly abutting one another.

Figure 15:
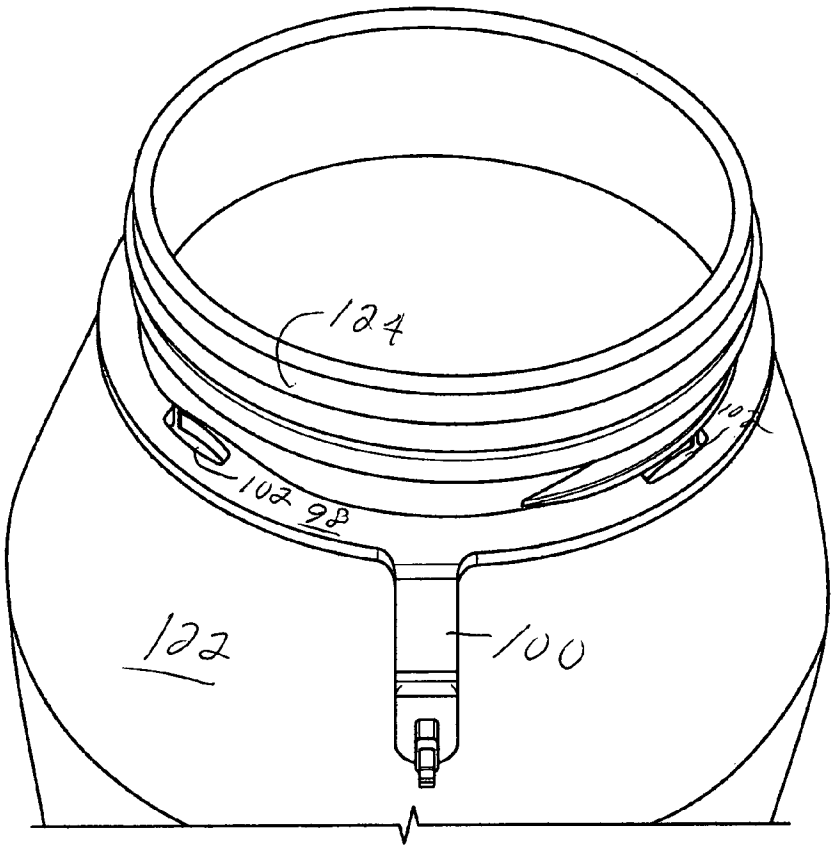
FIG. 15 is a perspective view of the ring of FIG. 13 assembled around the neck of a container.

FIG. 15 shows a fluid container or vessel 122 with a threaded neck 124 for receiving a cap or pouring device. The ring or collar 98 encircles the neck 124 and the gripping finger 106 engages against the neck 124 with a pressure to keep the ring 98 generally in place during movement of the container 122 when pouring liquid therefrom. The hanger finger 100 extends downwardly on the container to provide a means of mounting the label pockets 48 and 78 or the frame 30 with an informational pocket inserted therein.

Figure 16A:
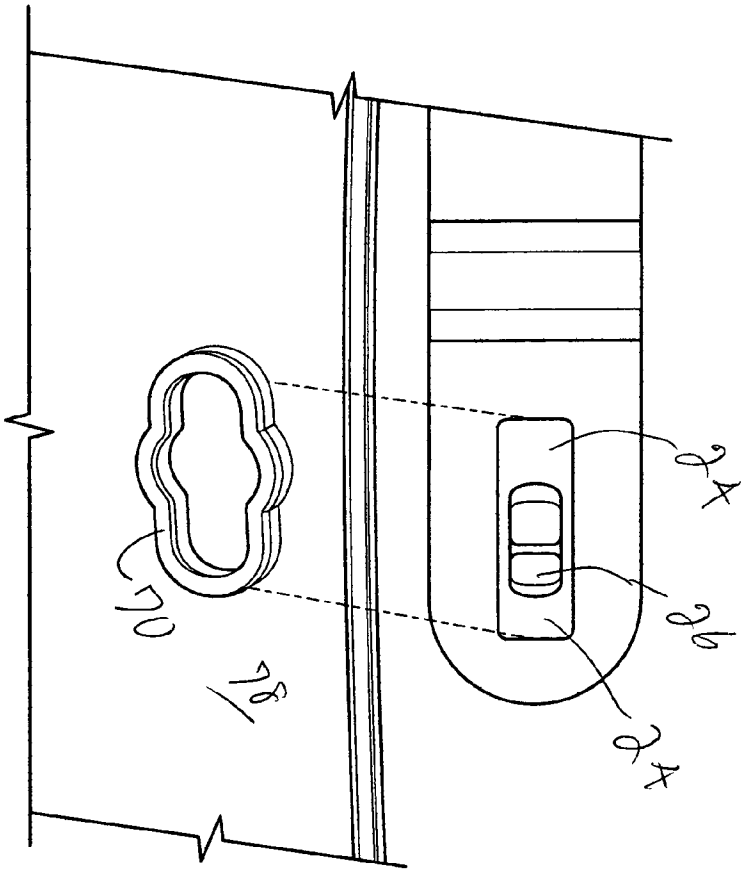
FIG. 16A is a partial perspective view of a pocket with its opening turned 90° and orientated in the proper alignment to fit over the pair of blades and male nib as show in FIG. 15.
Figure 16B:
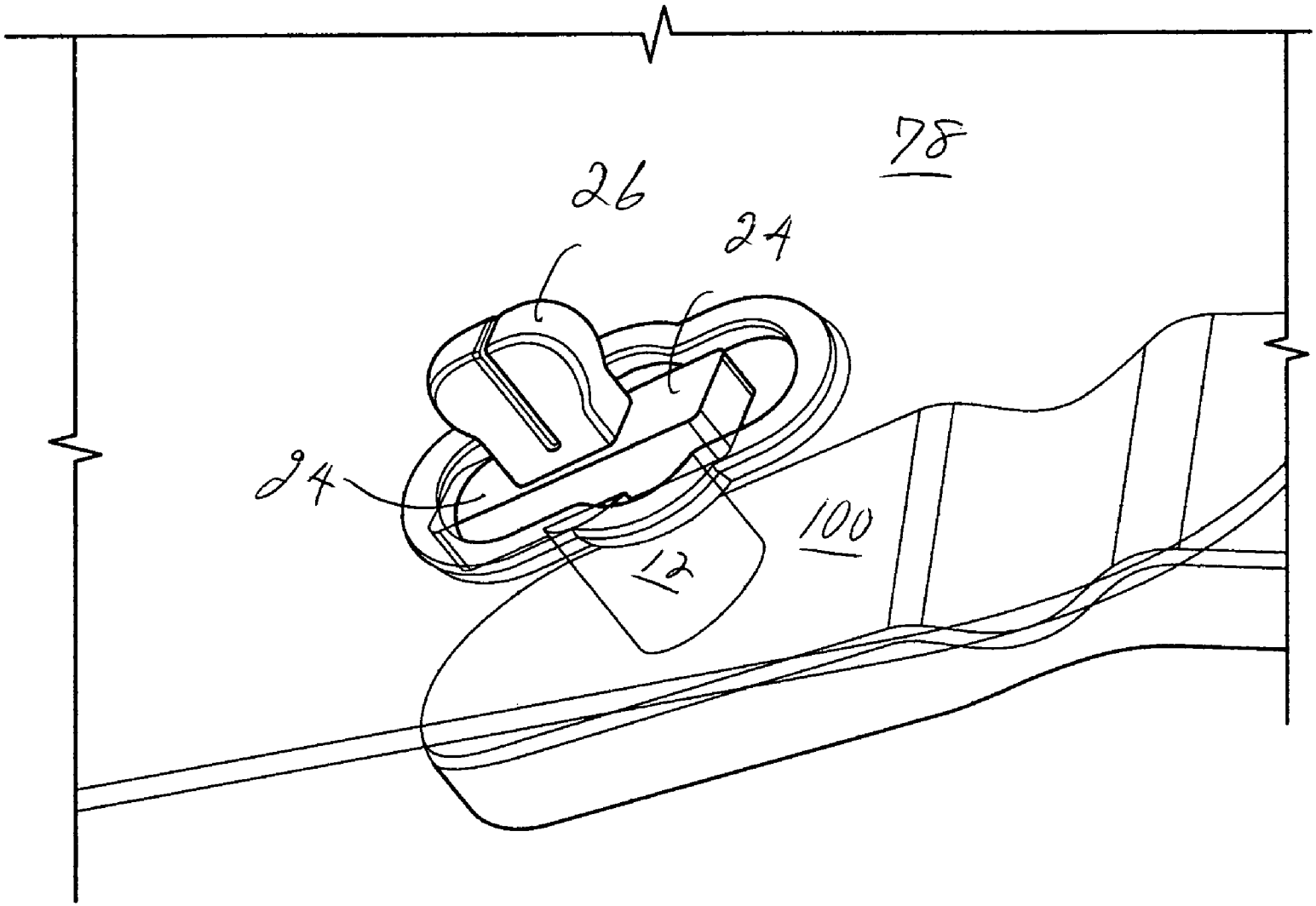
FIG. 16B is a partial perspective view of the pocket opening being inserted over the pair of blades and male nib as shown in FIG. 16A.
Figure 16D:
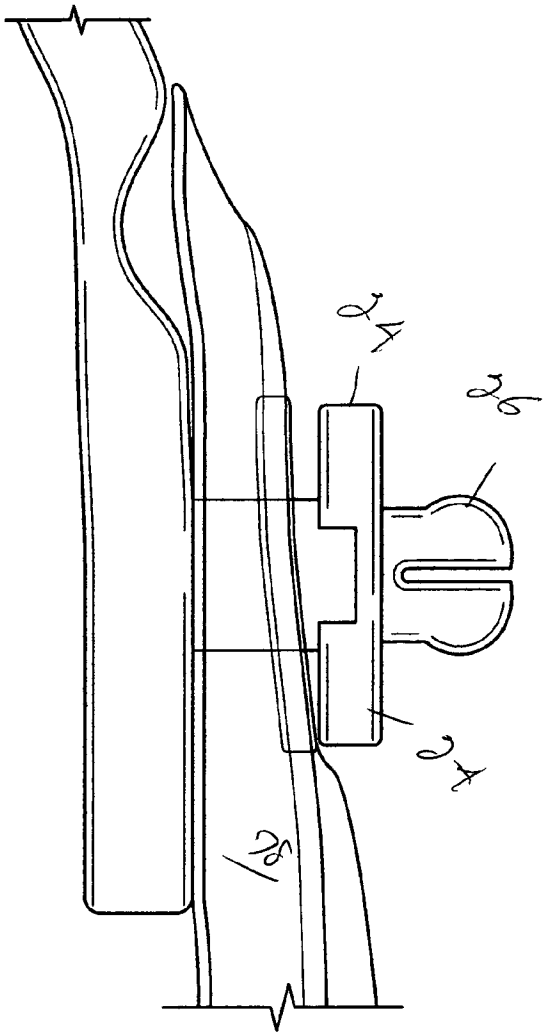
FIG. 16D is a partial perspective view of the pocket opening over the post, blades and male nib with the pocket in its upright and locked position resting on the post.
Figure 16C:
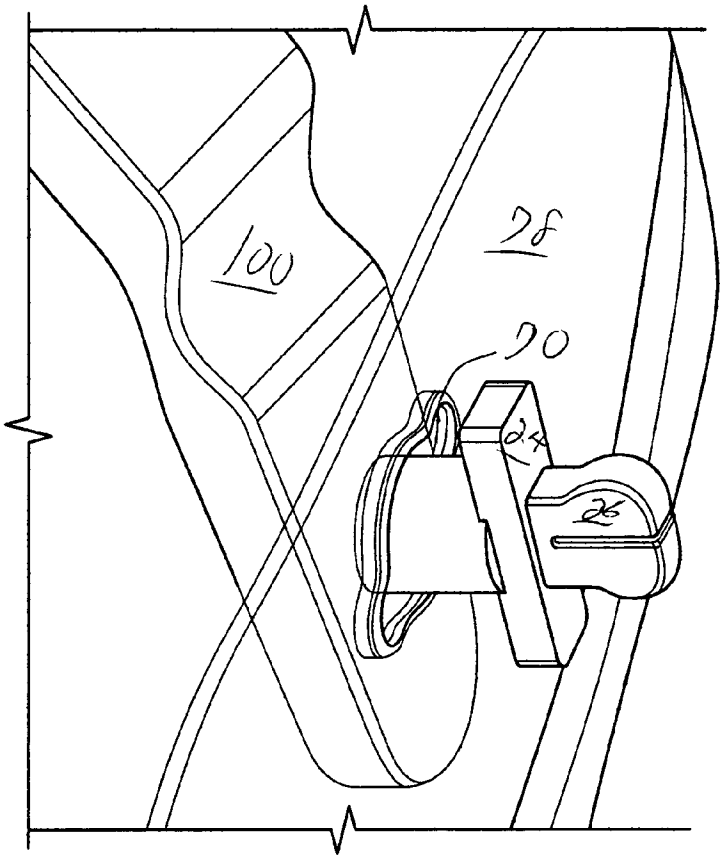
FIG. 16C is a partial perspective view of the pocket opening completely inserted over the pair of blades and male nib as shown in FIG. 16B.
Figure 16F:
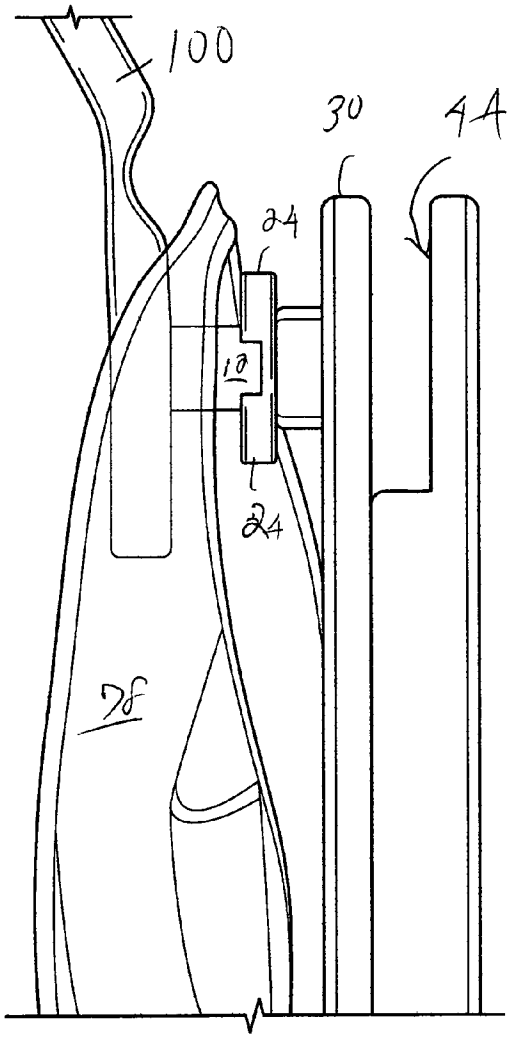
FIG. 16F is a partial side view perspective of the pocket on the post as shown in FIG. 16D with the male nib inserted into the female receptacle on the frame.
Figure 16E:
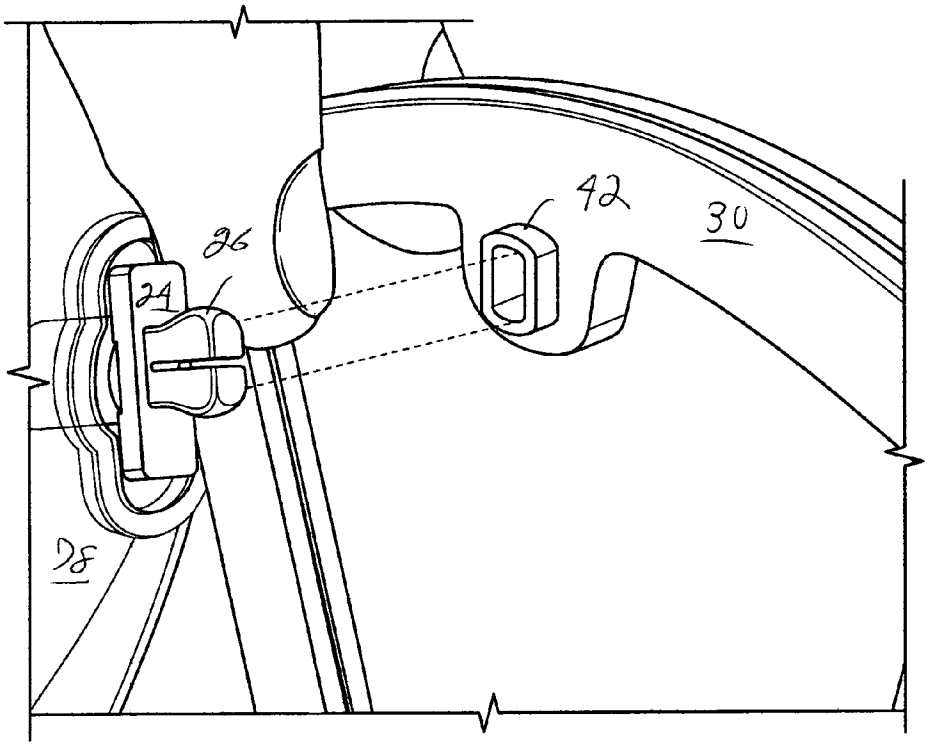
FIG. 16E is a partial perspective view of the pocket as shown in FIG. 16D and the male nib about to be inserted in the female receptacle on the rear of the frame.

For example FIG. 16A shows either the pocket 48 or 78 with the opening 70 aligned to be inserted over the male nib 26 and blades 24 onto the post 12 behind the blades as shown in FIG. 15. FIG. 16B shows the hole 70 of the pocket being inserted over the top blade 24 before the hole is lowered to encompass and pass over the lower blade 24. FIG. 16C shows the hole 70 of the pocket 48 completely inserted over the nib 26 and blades 24 to rest on the post 12 attached to the hanger 100. FIG. 16D shows a vertical view of the pocket 48 with its hole 70 around the post 12 behind the blades 24 and male nib 26 of the projection 10. FIG. 16E shows the nib 26 about to be inserted into the female receptacle 24 on the frame 30 with the pocket 48 resting on the post 12 behind the blades 24. FIG. 16F is a side view of the recently inserted pocket 48 on the post 12 mounted to the hanger 100 with the nib 26 of the projection 10 attached to the frame 30 having the slotted top opening 44 as shown through FIGS. 16A-16E.

Figure 17:
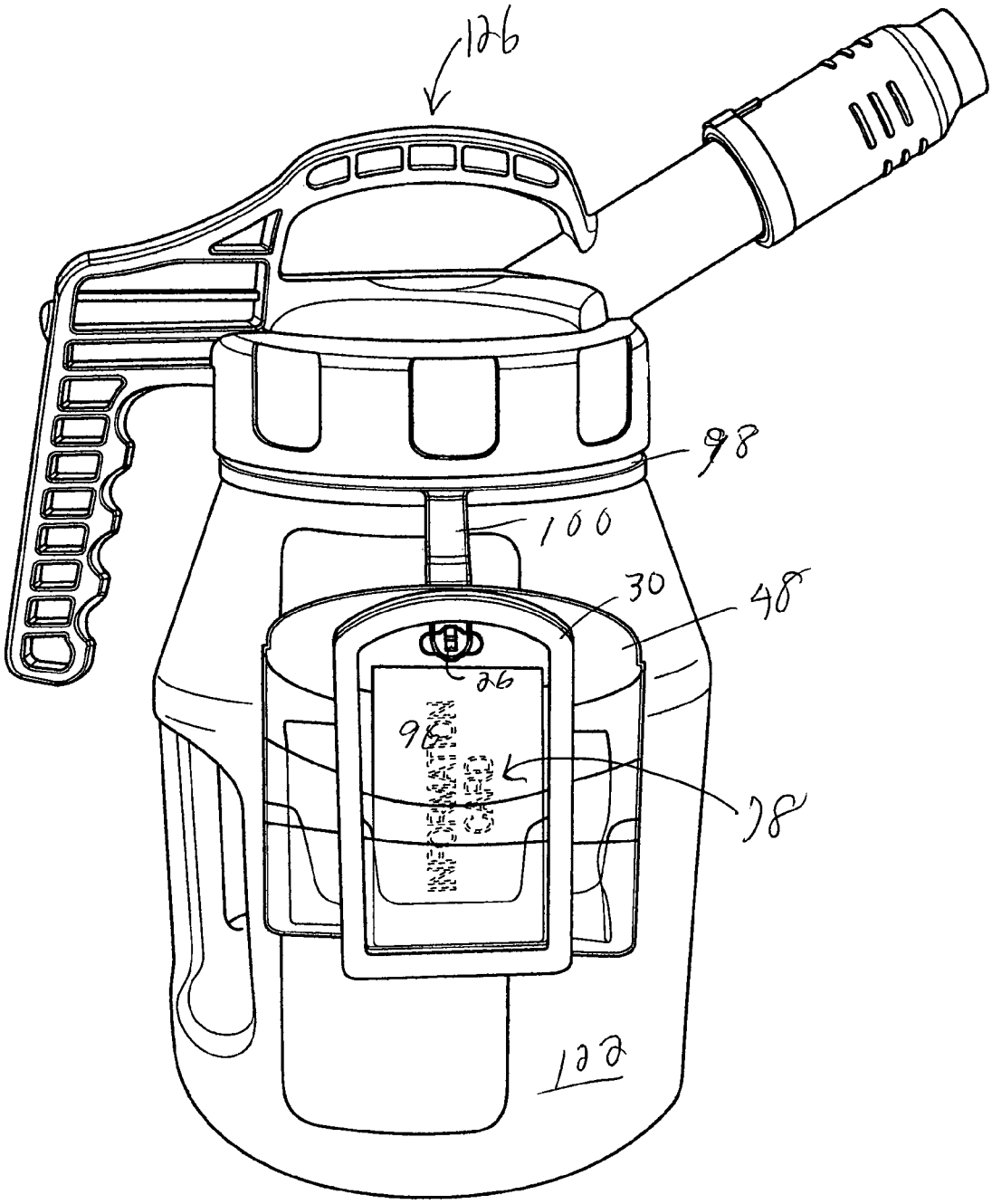
FIG. 17 is a perspective view of a fluid container with a dispensing spout and handle with the ring of FIGS. 13-15 fastened to the neck of the container with first and second pockets including the frame with a pocket inserted therein attached to the post and male nib as shown in FIGS. 1, 9-13, 15-16F.

Now turning to FIG. 17, all of the prior components of the supply chain label system described in FIGS. 1-16F come together on the container or vessel 122 to show a typical application of the labeling system and method demonstrating how to devise a best practice fluid identification system that allows fluid management from bulk containers to point of use. The advanced labeling system shows a container 122 with a pouring cap 126 threaded onto the threaded neck 124. A label ring 98 is connected around the threaded neck 124 and the male and female members of the joint 108 are closed together to secure the ring 98. The hanger 100 hangs down the side of the container 122 and includes the clear plastic pocket 48 with its pertinent information about the fluid or some safety information. The female receptacle 42 of the frame 30 is snapped fit onto the male nib 26, which does not extend into the slotted opening extending down the inside rails of the frame 30 so the pocket 78 can be inserted and removed to change the information card 96 within the pocket of the label pocket 78. A handle 128 is attached to the cap to pour the fluid through a spout 130.

Figure 18:
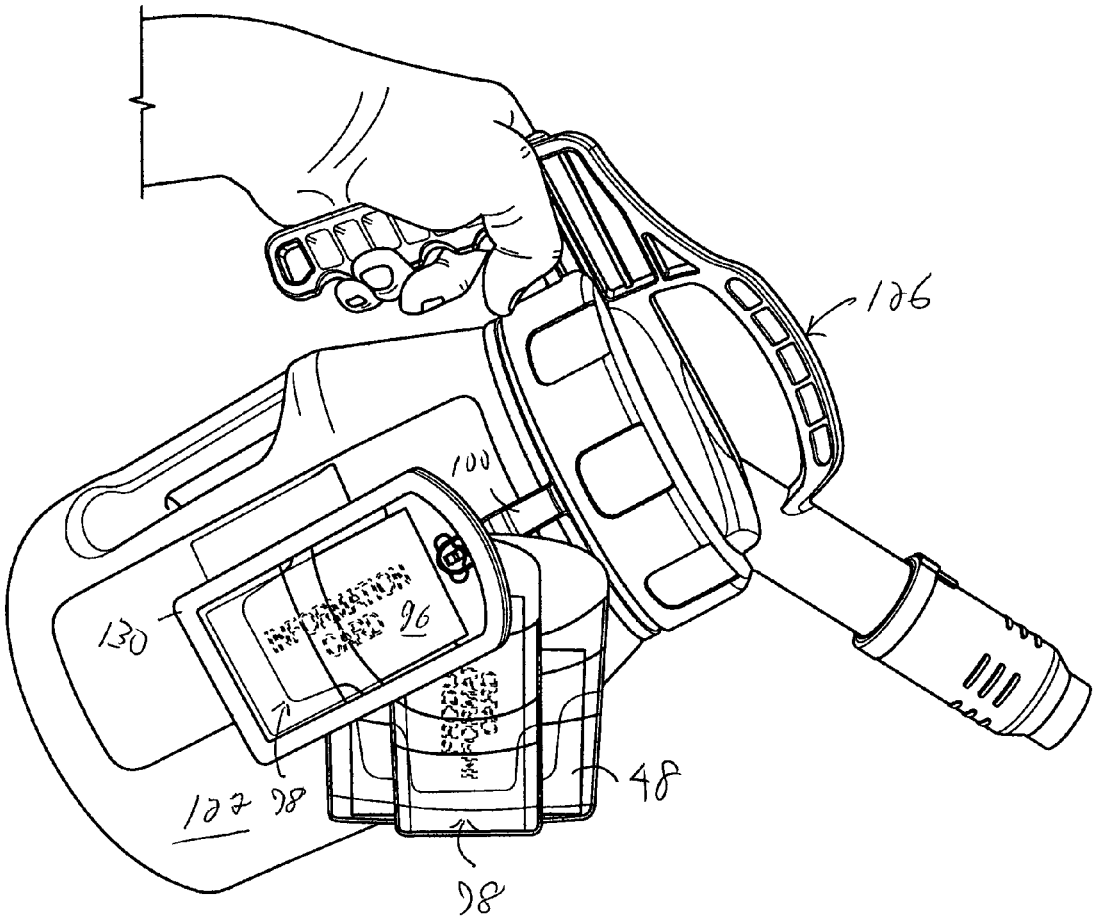
FIG. 18 is a perspective view of the container as shown in FIG. 17 in a pouring configuration with the first and second pockets rotating on the post and the frame with a pocket of information in a fixed relationship to the container mounted on the male nib.

FIG. 18 shows a container in use by the operator. An operator hand 132 grips the handle 128 of the container 122 and tips the container 122 to pour fluid out of its spout 130. The label pockets 48 and 78 rotate freely about the post 12 on the opening 70 with gravity maintaining the pockets 48 and 78 on the post 12 essentially vertical to the ground as the fluid is poured out of the container 122. However, the frame 30 remains in a fixed position with respect to the container 122 because the connection between the nib 26 and female receptacle 42 is generally a rigid connection that does not permit the movement of the frame 30 during a pouring operation. The information cards 96 are inserted into the pockets 48 and pocket 78 to provide the identity information necessary to safely handle the fluid contents within the container 122 for the factory maintenance personnel.

Figure 19:
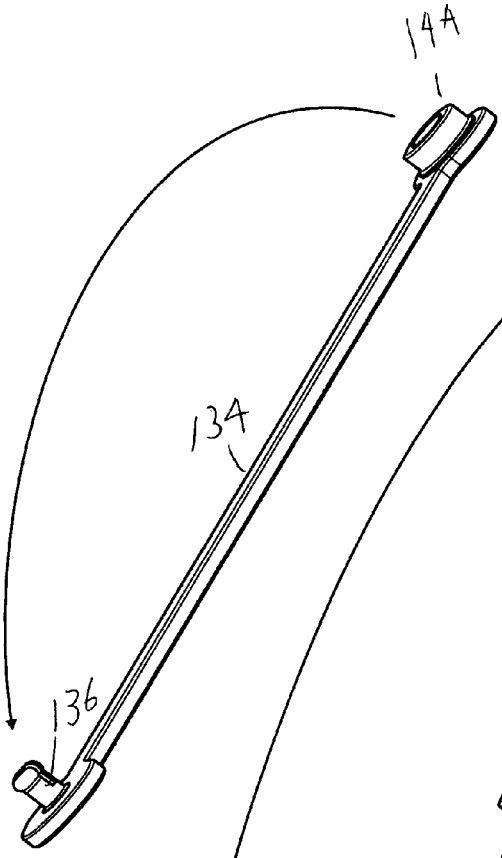
FIG. 19 is a perspective view of a pocket tie including a male and female member at opposing ends of the tie.
Figure 20:
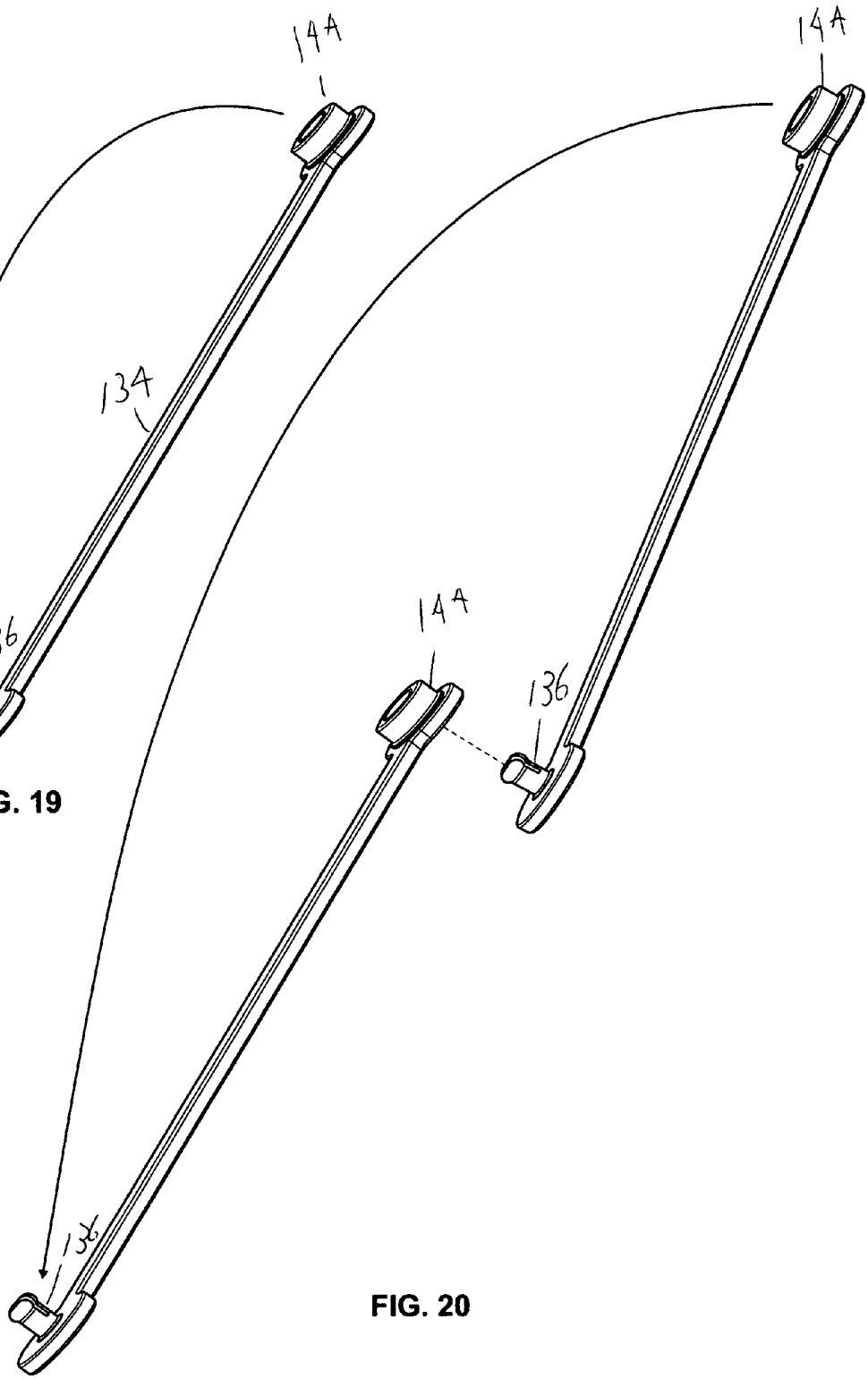
FIG. 20 is a perspective view of a pair of pocket ties as shown in FIG. 19 showing the connection of the male and female members being disposed to join together at their ends, respectively.

FIGS. 19 and 20 show a generally flat tie strap 134 with a male post 136 at one end 138 having a knob 140 at its distal end and a slot 142 extending from the top of the knob 140 down through the post 136 a predetermined distance. A raised female connector 144 is located at the other end 146 that has an opening extending all the way through the end 146 of the strap 134. In operation, the person using the strap 134 in FIG. 19 either rotates the female connector 144 onto the knob 140 on the male post 136, which causes the knob 140 to flex inwardly squeezing the opposing sides of the slot 142 toward one another to cause a snap fit relationship between the female connector 144 and the male post 136 to form a secure connection between the male and female members. Thus the tie strap 134 can be inserted through the opening 70 of a pocket 48 or 78 and then around a pipe, handle on a container or some other device and then the female and male members are joined together to hang the pockets 48 or 78 on the container 122 or other device for dispensing fluid or lubricants. Further, FIG. 20 shows two identical tie straps 134 that are joined together by having a male post 136 of one strap 134 inserted through the back of another tie strap 134 into its female connector 144 of the other tie strap 134 to form a daisy chain of two or more tie straps 134 to form a loop by closing the last remaining female connector 144 at the end of the chain to the first male post 136 at the beginning of the daisy chain. This loop of varying size depending on the number of tie straps 134 that are connected together provides a loop connection to a residential, commercial or industrial machine, container or other device to help identify the application, contents or fluids to be used in fluid management system by having the identification information on the tags or cards 96 within a pocket 48 or 78 at the point of use with the equipment.

Figure 21B:
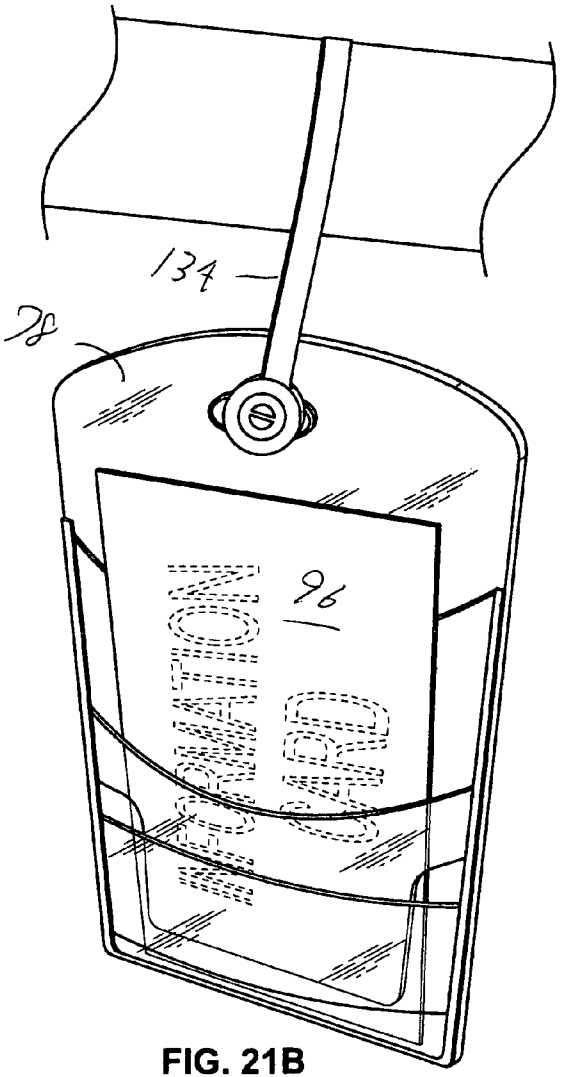
FIG. 21B is a partial perspective view of a tie around a pipe and through the opening of a pocket and then the female and male ends thereof snapped together to support the pocket with identification information.
Figure 21A:
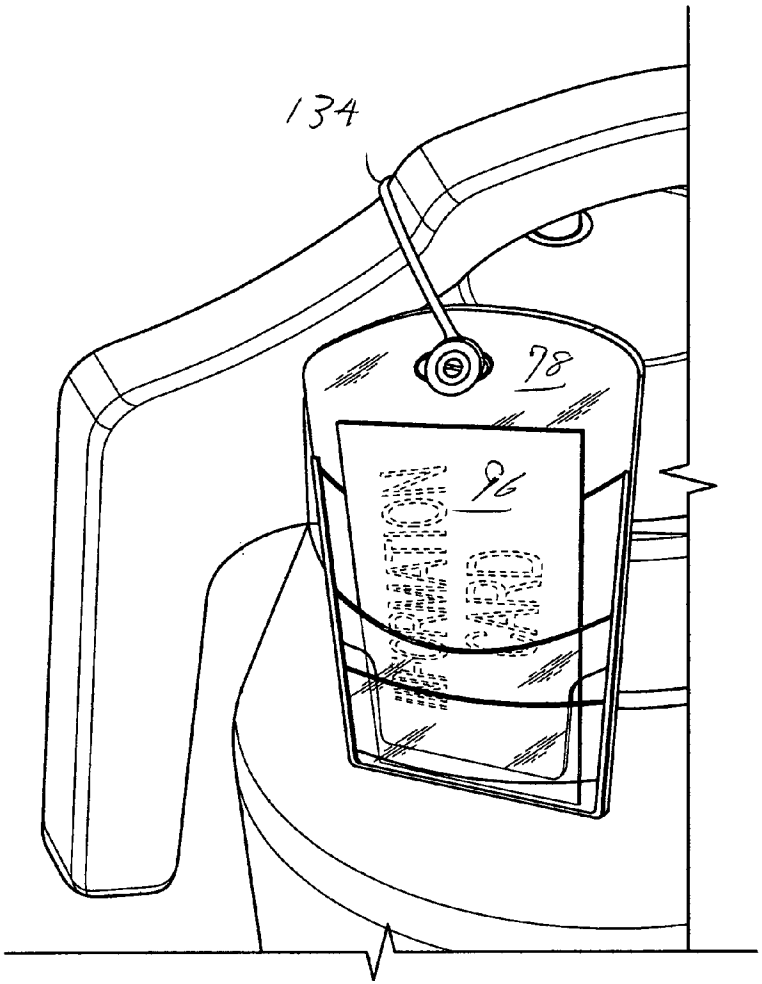
FIG. 21A is a partial perspective view of a pocket tie through the opening of a pocket and the opposing ends snapped together to form a closed loop around the handle of the container shown in FIG. 17 to hold a pocket with fluid management information.

FIGS. 21A and 21B show just the type of applications where the tie strap 134 is wrapped around the handle 128 of the container 122 and is inserted through the opening 70 of the label pocket 78 with the information card 96 inserted into its pocket and the male post 136 with its knob 140 is connected to the female connector 144 to form the loop around the handle 128. FIG. 21B shows the same tie strap 134 forming the connecting loop around a pipe 148. The label pocket 78 with its information card 96 is held in place by the tie strap 134 extending through the opening 70 in the pocket 78 with the male member 136 inserted into the female connector 144 to complete the loop.

Figure 22:
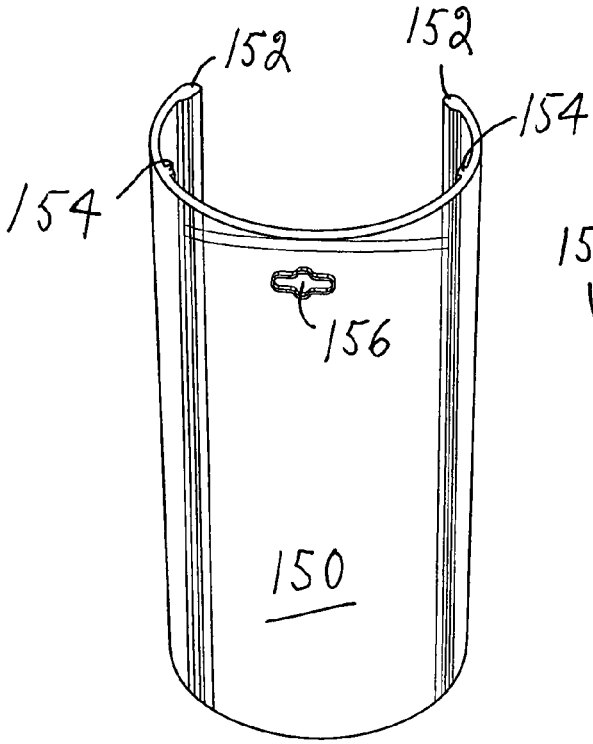
FIG. 22 is a perspective view of a cylindrical wrap around label holder for placement over a cylindrical equipment to identify information associated with the equipment.
Figure 23:
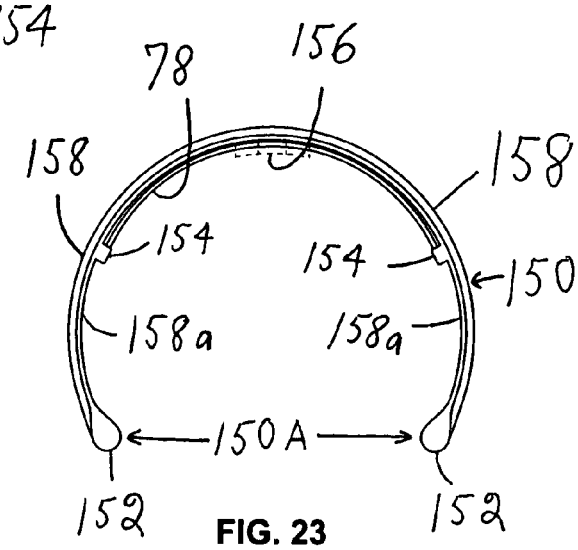
FIG. 23 is a top plan view of the holder as shown in FIG. 22 with a pocket as shown in FIGS. 21A and 21B inserted in a friction fit against the center interior wall of the cylindrical holder and held in place by a pair of vertical rails extending the length of the cylindrical wall in a spaced apart relationship and held in place with a raised generally flat embossed surface corresponding to the opening in the pocket.
Figure 24:
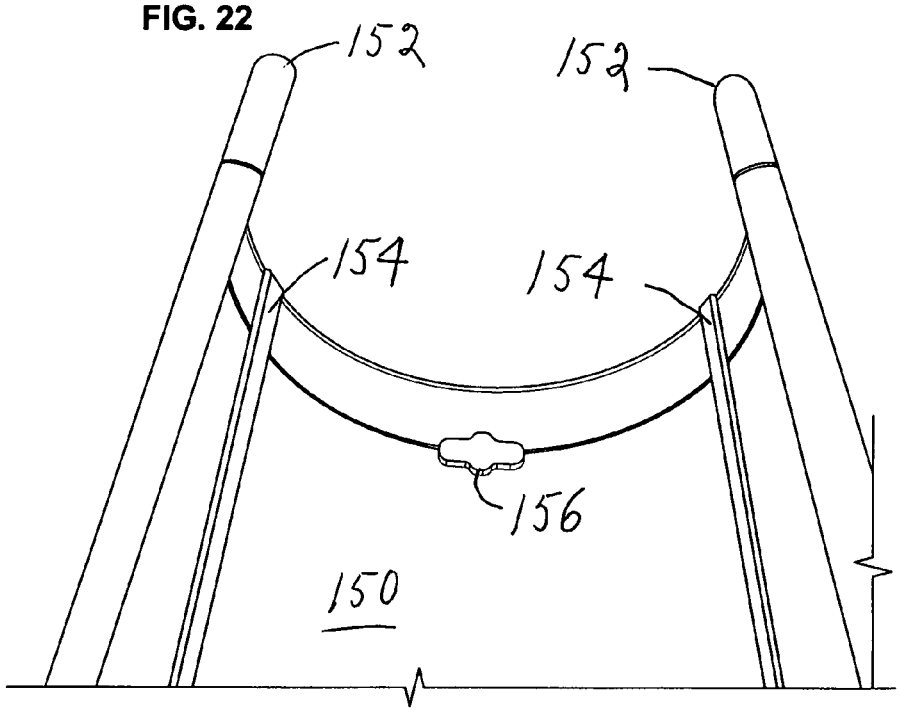
FIG. 24 is a partial perspective frontal view of the cylindrical holder of FIGS. 22 and 23 showing in greater detail the pair of rails and the raised embossed projection extending through the opening in the pocket without the pocket as shown in FIG. 23 and other figures.
Figure 25:
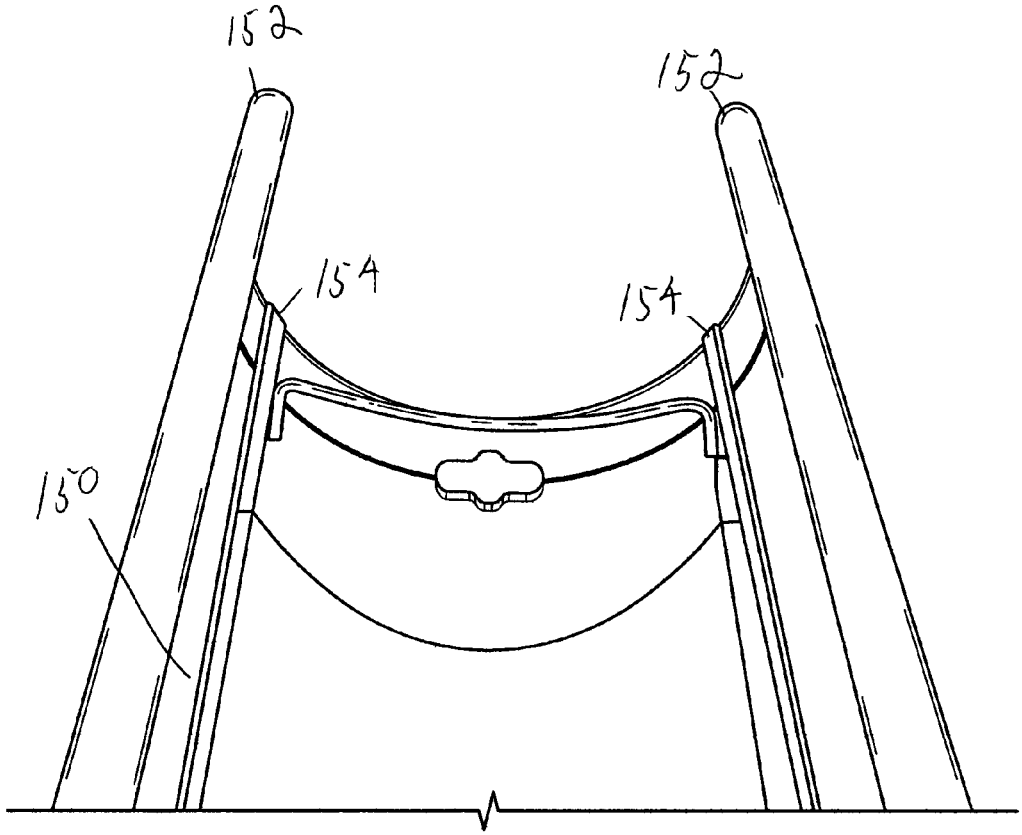
FIG. 25 is a partial perspective frontal view of the cylindrical holder of FIG. 24 with a pocket inserted against the wall.

Next, in FIGS. 22-28, the supply chain label system employs yet another holder, which is a clear plastic partial semicircle sleeve 150 that clamps or press fits onto a cylindrical piece of equipment, device or apparatus. The sleeve 150 includes a curved outer wall surface 158 and a curved inner wall surface 158A. The sleeve is made out of a single piece of clear plastic semicircle vertical tubing having a cross section greater than one half of a circle terminating with a pair of integral rounded vertical edges 152 defining a vertical opening 150A for passing through a cylindrical body of the device that an operator wants to place operating or fluid management instructions thereon. The body of the cylindrical device that sleeve 150 is being attached to through the opening 150A causes the vertical edges 152 to flex outwardly as the cylindrical body of the device is passing through the opening 150A. The vertical edges 152 then flex inwardly once the cylindrical body is within the semicircle tubing sleeve 150 to providing the clamping action upon the cylindrical body. This configuration provides the clamping or press fit action upon mounting the sleeve 150 on any cylindrical device. The sleeve 150 further includes a pair of integral spaced apart vertical rails 154 formed on the interior surface wall 158A extending the entire interior length of the sleeve 150. The semicircle configuration greater than half of a circle in cross section securely retains the sleeve 150 on cylindrical body of the target fluid container or device. To remove the sleeve 150, it must be pulled off a cylindrical body that it is mounted to with a predetermined force that is able to flex the vertical edges 152 outwardly again for removing the cylindrical device therein by passing through the opening 150A. The spacing of the rails 154 permits a label pocket or pouch 78 to flex against the curved inner wall surface 158 as it is captured between the two rails 154. A raised embossed retainer 156 coinciding with the opening 70 in the label pocket 78 extends upwardly through the opening 70 in the label pocket 78 to fixedly secure the flexed pocket 78 from vertical movement within the sleeve 150 and against the inner wall surface 158*a* as shown in FIGS. 22 and 23. FIG. 25 shows a label pocket 78 with the embossed retainer 156 extending through the pocket opening 70 on the label pocket 78 to hold the pocket 78 in place against the inner wall surface 158 in a fixed relationship thereto and between the opposing vertical rails 154. With the label pocket 78 captured in this way, the sleeve 150 is able to slide up and down on a cylindrical device without the pocket 78 becoming dislodged from its fixed position within the sleeve 150. This relationship will be described in greater detail later and this feature will become more apparent from the drawings showing the mounting of the sleeve 150 on devices with the label pocket 78 mounted inside.

Figure 26:
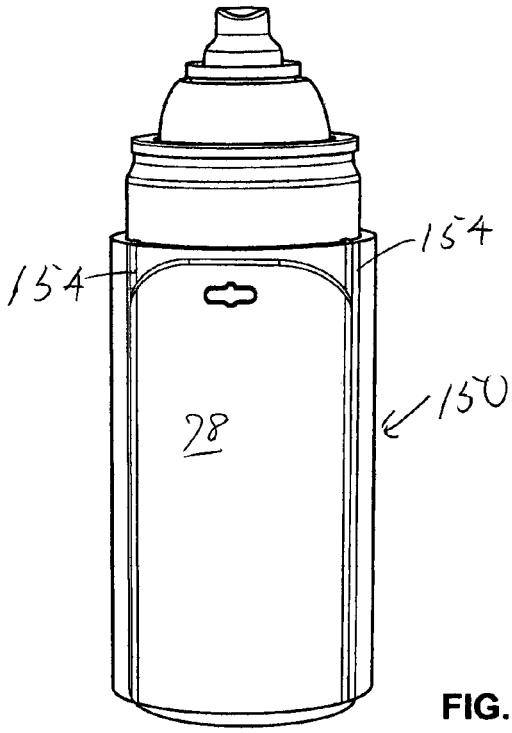
FIG. 26 is an aerosol can of fluids with the wrap around cylindrical label holder snap fit onto the can with a pocket as shown in FIGS. 23 and 25, respectively.

FIG. 26 shows the clear plastic sleeve 150 with a label pocket 78 mounted on the inside surface of the sleeve 150 clamped onto an aerosol can 160 containing fluid. The plastic outer surface 158 protects the clear plastic label pocket 78 from harsh chemicals and other fluid within the typical aerosol can 160 or from damage during storage and handling that typically destroys the directions and label instruction on the outer surface of the aerosol can 160. So the end user of the aerosol always has the directions readily available in the label pocket 78 on how to apply the fluid along with any instruction or precautions in using the fluid, in case there is spillage or vapor concerns that need to be addressed for safety reasons. Any new notices, directions or instructions concerning the dispensing of the fluids in the aerosol can 160 is then easily updated by removing the old information in the pocket 78 and replacing it with the new information.

Figure 27:
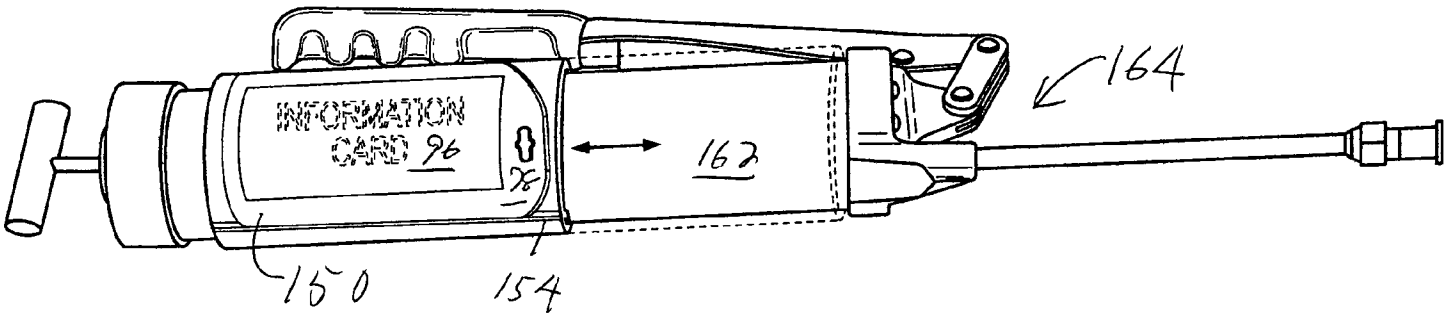
FIG. 27 is a perspective view of a cylindrical label holder attached to a grease gun with a pocket including informational card therein with ghosted lines showing the ability to slide the holder up and down the barrel of the grease gun.

FIG. 27 show the sleeve 150 with the information card 96 in the label pocket 78 clamped or press fit onto a barrel 162 of a grease gun 164 come into contain with the operator and certain measures need to be taken for safety reasons. An arrow 166 on the barrel 162 of the grease gun shows that the sleeve 150 is capable of sliding back and forth on the barrel 162 of the grease gun 164 with its pocket 78 including the information card 96 held in place. This allows the operator to move the sleeve 150 with its information out of the way during a lubrication operation.

Figure 29:
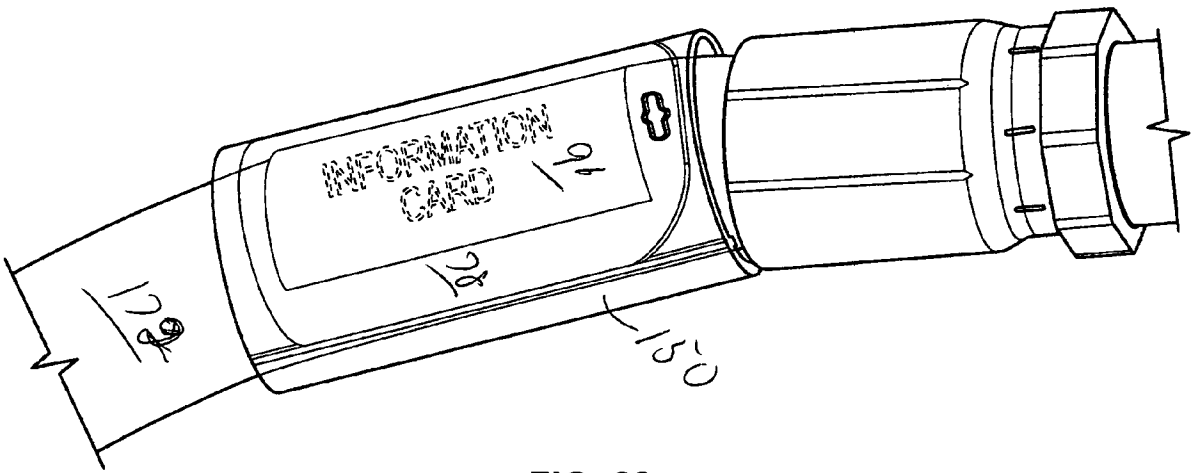
FIG. 29 is a perspective view of a cylindrical label holder attached to a hose with a pocket and identification information inserted therein attached to a hose.
Figure 28:
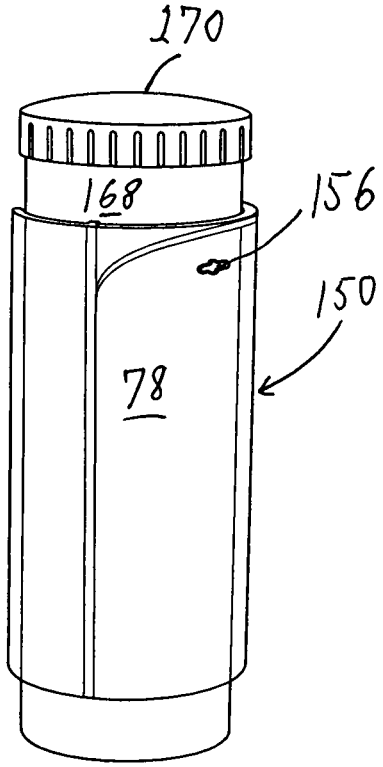
FIG. 28 is a frontal perspective view of a stack with a cap having the cylindrical label holder with a pocket inserted therein as shown in FIG. 27.

FIGS. 28 and 29 show additional attachments of the sleeve 150 and its pocket label pouch 78 to cylindrical bodies such as a filler tube 168 with a cap 170 in FIG. 28. FIG. 29 shows the sleeve 150 clamped onto a hose 172 on a machine tool or the like with the label pocket pouch 78 and its information card 96 therein.

Figure 30:
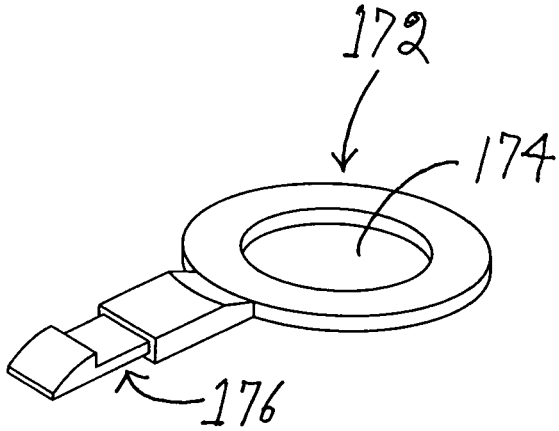
FIG. 30 is a perspective view of a collar to fit around a pipe or filler plug on a machine having a male stab.

Next, FIGS. 30-34 show the use of yet another holder in the best practice fluid identification system for the supply chain label system of the present invention. FIG. 30 shows a holder comprising a fill point identification washer 172 of a predetermined thickness that are made in different sizes to go around the standard filler tubes on reservoirs and other vessel containing fluids for machine tools and other equipment and the like. The diameter of the washer 172 and its opening 174 varies depending upon the size of the circumference of the filler tube. A stab finger 176 of a predetermined length, height and width extends generally horizontally outward from the outer edge 178 of the washer 172. A generally rectangular base 180 is attached to the outer edge 178 of the washer 172. The finger 176 is comprised of a base 180 of a predetermined thickness having a generally rectangular shape with one end 182 connected along the width of the outer edge 178 of the washer 172 with a base bottom 184 along the same plane as a bottom 186 of the washer 172 and a top 188 sloping upwardly a predetermined distance 190 before bending to a generally parallel surface 192. The finger 176 further includes a male stab portion 194 protruding a predetermined distance from the distal end 196 of the base 180 to form the male connector 194. The male connector 194 includes a flat rectangular shaped portion 198 connected to a wedge shaped portion 200 sloping downwardly toward to a distal end edge 202 for insertion into a female connector.

Figure 31:
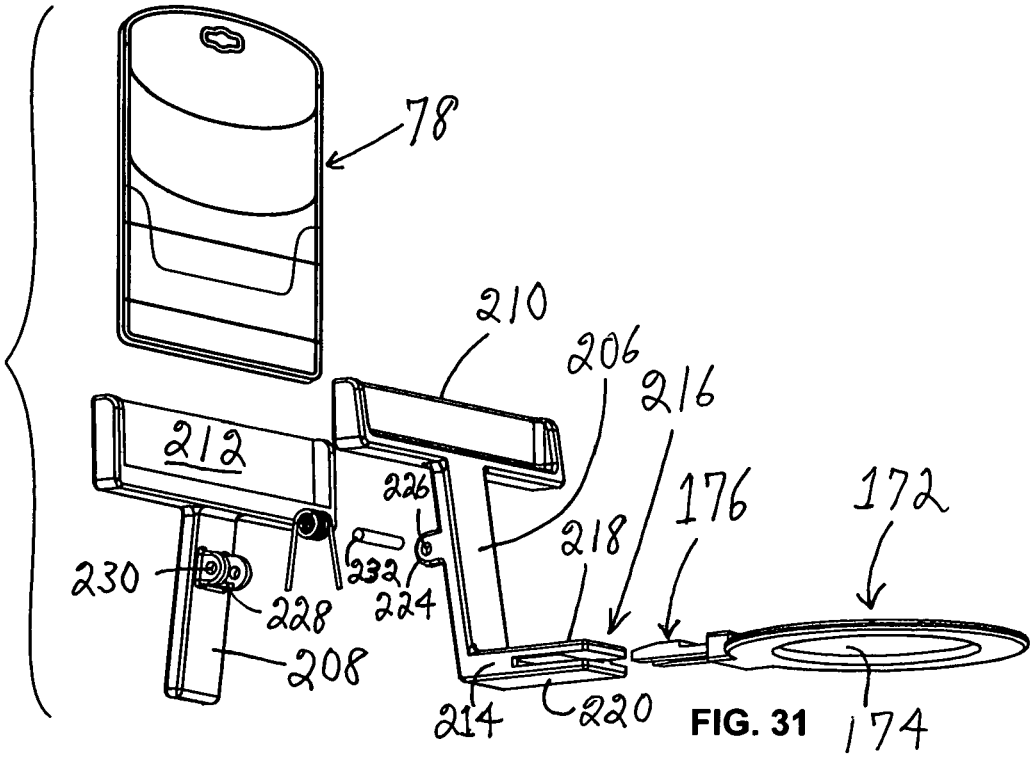
FIG. 31 is an exploded perspective view of the collar and male stab as shown in FIG. 30 for insertion into the female receptacle on a first clamp leg and a second clamp leg for insertion of a pocket therein before the spring causes the T cross members of the first and second legs to close on the pocket to hold it in place.

FIG. 31 shows an exploded view of the other components of the labeling system that are connected to the fill point identification washer 172. The male connector 194 of the washer 176 is inserted into a spring-loaded clamp 204. The spring-loaded clamp 204 is composed of two legs 206 and 208 having a pair of horizontal crossbars 210 and 212, respectively, forming an "A" shaped clamp 204 when the bars 210 and 212 are clamped together. The lower part of the leg 206 of the clamp 204 includes a generally horizontally disposed foot 214 having a female connector 216 at one end into which the male connector 194 is inserted. The female connector 216 includes a pair of generally opposing horizontal flat rectangular members 218 and 220 forming the female receptacle for the male connector 194. The top female member 218 includes an opening 222 extending through the top female member 218 having dimensions corresponding generally to the width of the wedge portion 200 and a length equal or greater than the length of the wedge portion 200. When the distal end 202 of the wedge is inserted into the female connector 216, the top member 218 and bottom member 220 flex further apart as the leading edge of the top female member 218 travels up the slope of the wedge 200 until a rear edge 224 of the wedge portion 200 snaps upwardly into the opening 222 and the female members 218 and 220 return to their normal parallel spaced apart positions. The rear edge 224 of the wedge 200 on the male connector 194 when fully inserted into the female connector 216 is abutting against the rear edge of the opening 222 in the female member 218 and thus held securely in place without the ability for the male connector 194 to pull out of its connection with the female connector 216 until the operator pulls the female member 218 upwardly to release the edge interference between the wedge 200 and opening 222.

As shown in FIG. 31, the length of the leg 206 extends upwardly in an obtuse angle from the foot 214 to the horizontal crossbar 210. A pair of opposing spaced apart hinges 224 with pin openings 226 extend from the rear surface of the leg 206 to match a generally identical pair of opposing hinges 228 and pin holes 230 projecting from the rear of the leg 208 so that the respective holes 224 and 228 can be aligned for inserting a hinge pin 232 having a spring 234 with ends 236 and 238 extending downwardly against the legs 206 and 208 when the legs 206 and 208 are hinged together with the pivot pin inserted into the aligned holes 226 and 230 on the respective hinges 224 and 228 to form the clamping action between the crossbars 210 and 212. Crossbar 212 includes a recess 240 with a slot 242 at the bottom edge of the recess. The slot 242 is of a sufficient width to receive the bottom edge 86 of the label pouch 78 and the crossbar 210 generally is disposed partially within the recess 240 when clamped against the label pouch 78 within the recess 240 of the crossbar 212.

Figure 32:
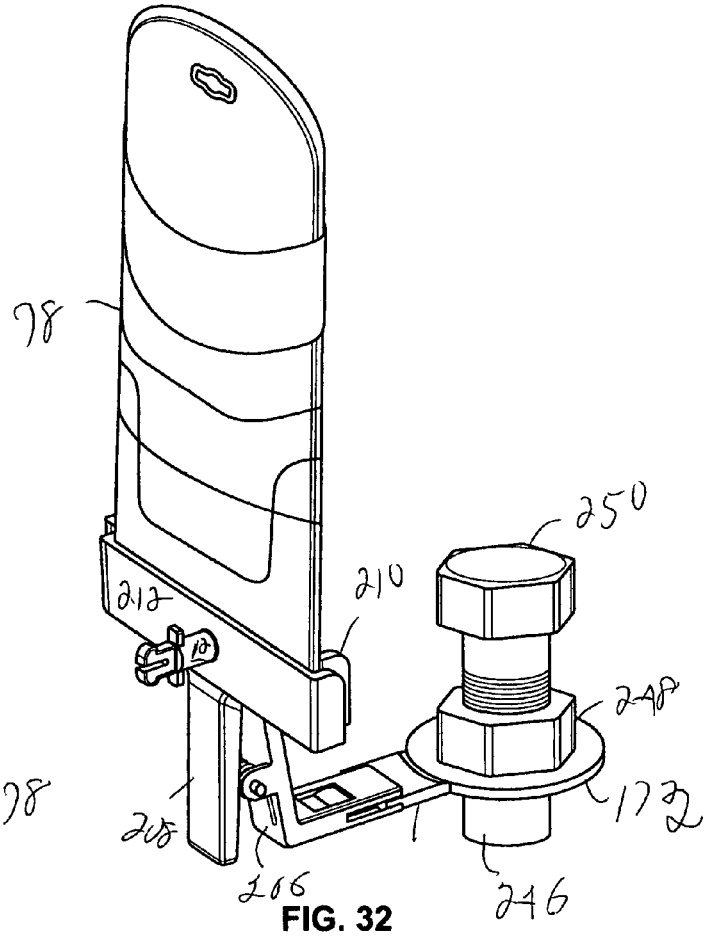
FIG. 32 is a perspective view of the collar and clamp assembled around a filler plug on a machine with a pocket in the clamping cross members as shown in FIG. 31.
Figure 33:
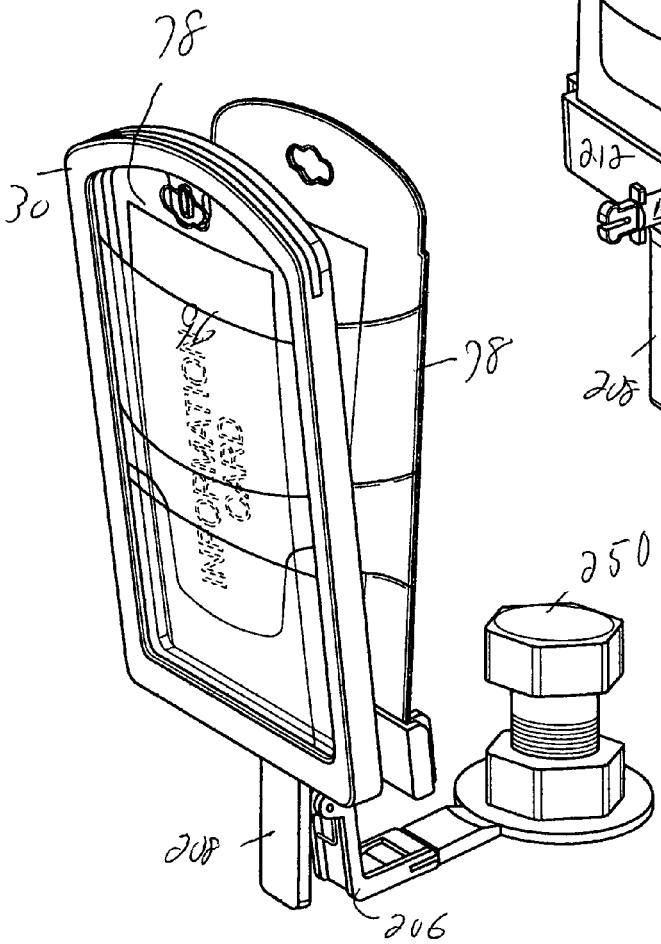
FIG. 33 is a perspective view of the label holder assembly of FIG. 32 with a frame attached to the male nib with a pocket including information inserted therein.
Figure 34:
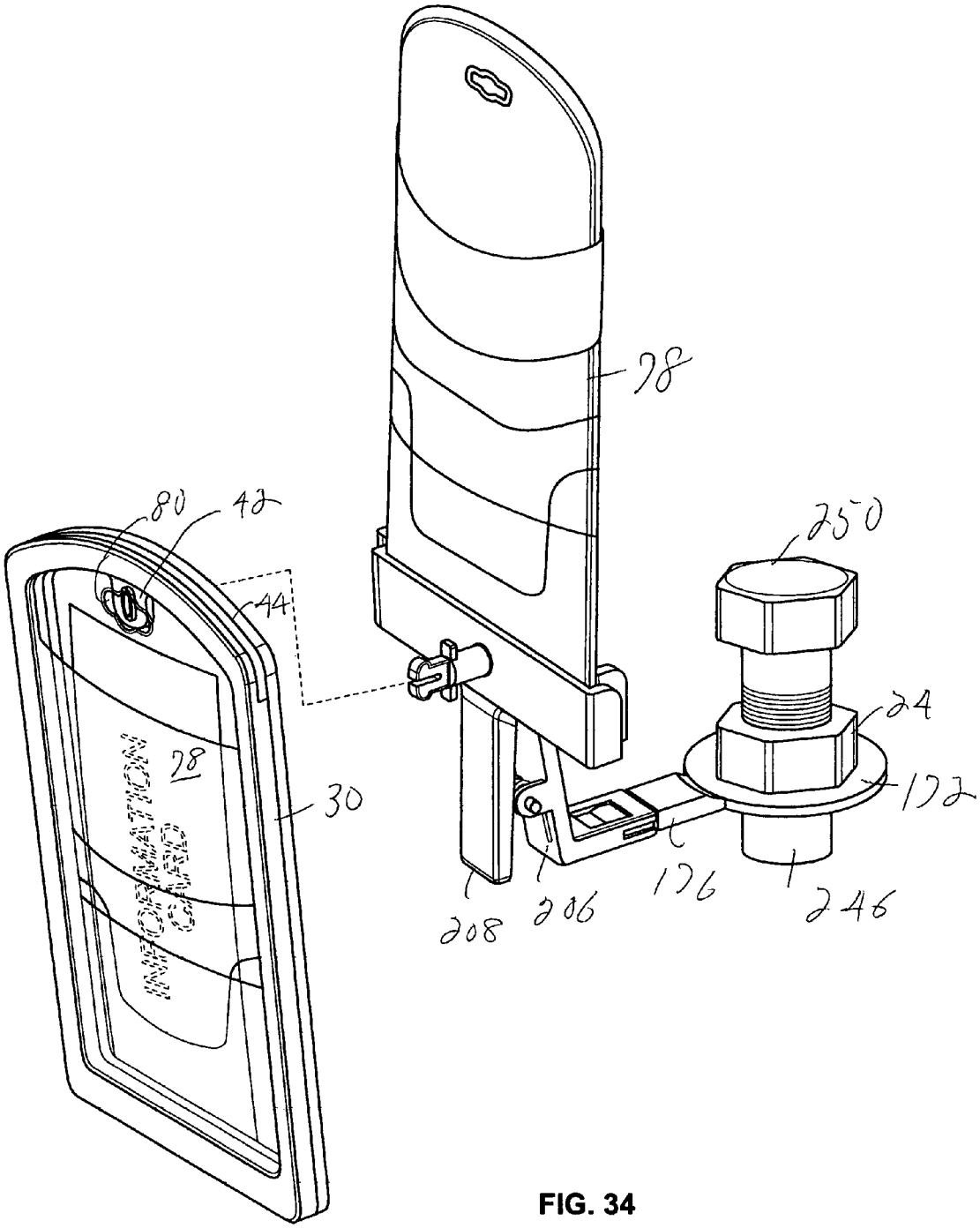

FIGS. 32 and 33 show the fill point identification washer 172 connected to a filler tube 246 having a nut 248 securing the washer 172 to the tube 246 with a threaded bolt 250 closing off the opening of the filler tube 246 for pouring the liquids therein. The male connector 194 is fully inserted into the female connector 216 with the clamp 204 holding the label pouch 78 between crossbars 210 and 212 and captured within the slot 242 in the recess 240 on the crossbar 212. FIG. 32 further shows the projection 10 attached to a rear surface 252 of the crossbar 212 in a generally central location. The post 12 of the projection is not entirely necessary with the existing clamp holding the label pouches 78 so just the male nib 26 connected to the rear surface for receiving a pouch frame 30 with the pouch 78 therein with the information card 96 would also make a suitable connection for the pouch frames 30 sized to hold either the pouch sizes 48 or 78. FIG. 34 shows a similar configuration as to FIGS. 32 and 33 for the filler identification washer 176 and the clamp 204 but with the pouch frame 30 having the nib 26 connected to the female receptacle 42 at the top of the frame to hang over the edge of a reservoir tank or vessel with the filler tube 246.

While the specific embodiments have been illustrated and described, numerous modifications come to mind without significantly departing from the spirit of the invention and the scope of protection is only limited by the scope of the accompanying Claims.

What is claimed is:

1. A labeling identification management system for residential, commercial or industrial products or equipment comprising:

a holder defining a support mechanism for attaching information about the products or equipment at the point of use; and a label pocket connected to the holder for inserting and protecting the information during use, storage or maintenance of the products or equipment;

wherein the holder includes a post of a predetermined length connected to a base, a crossbar generally perpendicular to the axis of the post and extending beyond the post on opposing sides a predetermined distance, and wherein the label pocket includes an opening therethrough at one end that fits over the crossbar and post for securing the pocket on the post between the base and crossbar.

2. The system of claim 1, wherein the holder further includes a generally bulbous nib extending axially above the post and passing through the opening in the pocket.

3. The system of claim 2, further comprising a frame housing the label pocket and the frame having a receptacle thereon for receiving the nib therein to fixedly secure the frame to the holder.

4. The system of claim 3, wherein the frame generally comprises an opposing top and bottom connected by opposing sides and the frame having an opening in the top in communication with parallel grooves running down the opposing sides, the grooves defining a label pocket slot in the frame for the slidable insertion of the label pocket into the pocket slot.

5. The system of claim 1, wherein the label pocket is constructed of a generally rectangular clear plastic material having a front and rear panel forming the pocket with a sealed top and bottom joined by two sealed vertical sides, an opening extending on the front panel a predetermined distance with a flap over the opening and secured to the front panel in the closed position to seal out moisture, dust and other environmental elements to protect the information within the pocket during use, storage or maintenance of the product or equipment associated with the label pocket.

6. The system of claim 5, further comprising a hanger opening near the top of the label pocket to receive the holder so that one or more label pockets are capable of being supported by the holder.

7. The system of claim 6, wherein the holder is associated with a cap base having a domed top and an open bottom, the holder is generally affixed to the center of the domed top and a magnetic material is within the dome and the material extends a predetermined distance below the dome to engage a metallic surface near or on the product or equipment to be managed.

8. The system of claim 1, wherein the crossbar comprises a blade.

9. The system of claim 8 wherein the crossbar comprises a pair of opposing blades extending perpendicularly outwardly from the axis of the post and beyond the circumference of the post a predetermined distance.

10. An identification system for management of fluids from bulk storage to point of use on equipment, comprising:

a holder having a base, a post connected to the base, a pair of opposing blades extending perpendicularly outwardly from the axis of the post and beyond the circumference of the post a predetermined distance, a male projection connected to and extending above the post and blades generally along the axis of the post, the male projection terminating in a generally bulbous head with a slot across its diameter and extending downwardly in the projection a predetermined distance;

a label pouch generally defined by rectangular front and rear panels sealed together at top, bottom and side edges to form a pouch space therebetween, an opening on the front panel generally extending above a midway point on the front panel to shortly before the top and between the side edges, a flap connected above the opening to the front panel and extending downwardly across the entire opening and connected to the front panel to close the pouch opening and to protect any insertion of information into the pouch space from environmental elements, a second opening through both the front and rear panels above the flap connection and generally center between the side edges having its length perpendicular to the side edges, and wherein the label pouch is rotated 90 degrees to fit the second opening over the male projection, blades and post to secure the pouch on the post between the base and blades.

11. The system of claim 10, further comprising a generally flat frame having four sides of a predetermined width, thickness and length including a top, bottom and a pair of parallel vertical sides joining the top to the bottom, a female receptacle generally centered on a rear of the top and bottom sides, a slot opening through the top of the frame and extending downwardly into a groove in each vertical side defining a opening to receive the pouch therein, wherein the frame is attached to the holder by mating the male projection with the female receptacle to hold the frame in a fixed relationship with respect to the holder.

* * * * *